US009772122B2

(12) United States Patent
Swett et al.

(10) Patent No.: US 9,772,122 B2
(45) Date of Patent: Sep. 26, 2017

(54) TURBO-COMPRESSOR-CONDENSER-EXPANDER

(71) Applicant: Appollo Wind Technologies LLC, Saint Petersburg, FL (US)

(72) Inventors: Peter A. Swett, Reading, MA (US); Randell B. Drane, Winchester, MA (US)

(73) Assignee: Appollo Wind Technologies LLC, Saint Petersburg, FL (US)

( * ) Notice: Subject to any disclaimer, the term of this patent is extended or adjusted under 35 U.S.C. 154(b) by 229 days.

(21) Appl. No.: 14/543,868

(22) Filed: Nov. 17, 2014

(65) Prior Publication Data

US 2016/0138612 A1 May 19, 2016

(51) Int. Cl.

| | |
|---|---|
| ***F25B 1/00*** | (2006.01) |
| ***F25B 1/053*** | (2006.01) |
| ***F04D 29/38*** | (2006.01) |
| ***F04D 29/58*** | (2006.01) |
| ***F25B 1/10*** | (2006.01) |
| ***F25B 39/04*** | (2006.01) |

(52) U.S. Cl.

CPC ..... *F25B 1/053* (2013.01); *F04D 29/388* (2013.01); *F04D 29/582* (2013.01); *F04D 29/584* (2013.01); *F25B 1/10* (2013.01); *F25B 39/04* (2013.01); *F25B 2500/18* (2013.01)

(58) Field of Classification Search

CPC ... F25B 1/053; F25B 31/00; F28F 5/04; F28F 1/40; F28F 9/26; F04D 17/12; F04D 17/40; F28D 11/08

See application file for complete search history.

(56) References Cited

U.S. PATENT DOCUMENTS

| | | | |
|---|---|---|---|
| 2,424,878 | A | 5/1941 | Bode |
| 2,393,338 | A | 1/1946 | Roebuck |

(Continued)

FOREIGN PATENT DOCUMENTS

| | | | |
|---|---|---|---|
| BE | 654270 | | 10/1964 |
| EP | 1790933 | B1 | 5/2007 |

(Continued)

*Primary Examiner* — Elizabeth Martin

(74) *Attorney, Agent, or Firm* — Loginov & Associates; William A. Loginov

(57) ABSTRACT

An isothermal turbo-compressor-condenser-expander (ITCCE) arrangement includes heat-transferring fan blades that are mounted on, or surround, individual conduits to promote air exchange and heat transfer. The open framework rotates in free air to promote heat exchange. An ITCCE bladed assembly includes a driven central hub assembly with a first fluid coupling. A first inner plenum is in fluid communication with the fluid coupling. A plurality of compressor conduits extend radially, and pass fluid from, the first inner plenum to an outer plenum that acts as an equalizing line. A return path is provided to a second inner plenum from the outer plenum. The conduits can be formed as metal extrusions, including internal ribs separating a plurality of ports formed therebetween along an entire length of the conduits. The conduits can define an airfoil shape and/or are axially twisted, generating axial airflow. The return path can include return multiport conduits.

20 Claims, 26 Drawing Sheets

(56) References Cited

U.S. PATENT DOCUMENTS

| | | | | |
|---|---|---|---|---|
| 2,522,781 | A | 9/1950 | Exner | |
| 3,332,253 | A | 7/1967 | Alexander | |
| 3,470,704 | A | 10/1969 | Kantor | |
| 3,902,549 | A | 9/1975 | Opfermann | |
| 3,981,627 | A | 9/1976 | Kantor | |
| 4,074,751 | A | 2/1978 | Ducasse | |
| 4,077,230 | A | 3/1978 | Eskeli | |
| 4,117,695 | A | 10/1978 | Hargreaves | |
| 4,178,766 | A | 12/1979 | Eskeli | |
| 4,242,878 | A | 1/1981 | Brinkerhoff | |
| 4,282,716 | A | 8/1981 | Momose et al. | |
| 4,311,025 | A | 1/1982 | Rice | |
| 4,420,944 | A | 12/1983 | Dibrell | |
| 4,420,945 | A | 12/1983 | Dibrell | |
| 4,464,908 | A | 8/1984 | Landerman et al. | |
| 4,513,575 | A | 4/1985 | Dibrell | |
| 4,524,587 | A | 6/1985 | Kantor | |
| 5,386,685 | A | 2/1995 | Frutschi | |
| 5,477,688 | A | 12/1995 | Ban et al. | |
| 5,674,053 | A | 10/1997 | Paul et al. | |
| 5,839,270 | A | 11/1998 | Jirnov et al. | |
| 6,508,630 | B2 * | 1/2003 | Liu | F01D 5/145 416/228 |
| 2005/0011637 | A1 | 1/2005 | Takano | |
| 2008/0264094 | A1 * | 10/2008 | Campagna | F01K 7/16 62/402 |
| 2010/0180631 | A1 * | 7/2010 | Roisin | B60H 1/3223 62/498 |
| 2014/0069138 | A1 | 3/2014 | Roisin et al. | |

FOREIGN PATENT DOCUMENTS

| | | | |
|---|---|---|---|
| WO | 0175290 | A1 | 10/2001 |
| WO | 2006017888 | A1 | 2/2006 |
| WO | 2008018812 | A1 | 2/2008 |

* cited by examiner

TURBO-COMPRESSOR-CONDENSER-EXPANDER

RELATED APPLICATIONS

This application is related to commonly assigned U.S. patent application Ser. No. 14/078,453, filed Nov. 12, 2013, entitled TURBO-COMPRESSOR-CONDENSER-EXPANDER, which is a divisional of co-pending U.S. patent application Ser. No. 12/691,383, filed Jan. 21, 2010, entitled TURBO-COMPRESSOR-CONDENSER-EXPANDER, now U.S. Pat. No. 8,578,733, issued Nov. 12, 2013, which claims the benefit of U.S. Provisional Patent Application Ser. No. 61/146,022, filed Jan. 21, 2009, entitled ISOTHERMAL TURBOCOMPRESSOR, the entire disclosure of each of which applications are herein incorporated by reference.

FIELD OF THE INVENTION

The present invention relates generally to the field of devices used for the compression and condensation of refrigerant in an air-conditioning, refrigeration, heat-pumping, or other cooling/heat-transfer system.

BACKGROUND OF THE INVENTION

In air-conditioning, refrigeration, heat-pumping, and other refrigerant-based systems, heat is removed from a colder side of a device or system and transferred to a warmer side. For example in the case of air-conditioning, heat is transferred from the interior of a building, vehicle or other enclosed space to the exterior atmosphere. A standard process of removing colder air from one chamber and transferring it to another chamber or area includes four steps: compression of a refrigerant, followed by heat expulsion to the warm side, followed by a sudden expansion or other means of decompression, and finally absorption of heat from the cold side.

According to a typical prior art system, such as that illustrated in FIG. 1, both a compressor and a heat exchanger are separately required to accomplish the first two steps of the refrigeration cycle. As illustrated, the prior art air-conditioning/cooling system 100 defined by a refrigerant loop includes a compressor 110 that compresses the refrigerant fluid (typically a gas at that stage) by pressurizing it, which causes its temperature to increase in the output, compressed refrigerant. An electrical (or other power source) drive typically delivers the mechanical energy required to perform the compression of the refrigerant. The compressor typically uses an impeller or piston or other arrangement to compress the refrigerant. As shown, the refrigerant flows through the system loop 100 in accordance with the flow arrows 121.

The system 100 also includes a condenser 120, comprising an exterior coil 122, that provides a surface area capable of sufficient heat exchange as the heat generated by the (heated) pressurized refrigerant within the coil is transferred to the exterior (cooler side) by the atmospheric air (or other transfer fluid) passing over the coil. This causes the refrigerant to expel heat and liquefy. Once a sufficient amount of heat is removed, the refrigerant is expanded and decompressed in an expansion valve 125, causing its temperature to drop to a temperature below that of the cold chamber. The refrigerant subsequently enters a heat exchanger 132, where it flows trough a set of coils 131 and is exposed (typically by means of a fan 140) to the air of the cold chamber, from which, by virtue of the refrigerant's lower temperature, heat is extracted and communicated to the refrigerant, which vaporizes in the process (i.e. the refrigerant "absorbs" the heat).

As the refrigerant passes through the heat exchanger 132 (consisting of coil 131 and fan 140) inside the chamber 130 and becomes warmer, heat is transferred from the surrounding space 132 by a fan 140 (or alternatively ram air, as in the case of vehicle motion), and produces cool air that is ejected into the space being the object of cooling. The refrigerant returns to a vapor phase based upon the heat withdrawn from the air that passed over the coil 131. The refrigerant vapor then returns to the compressor 110 to become a high-pressure gas again. The heat then flows from the high-temperature gas to the lower-temperature air of the space surrounding the coil 122. This heat loss causes the high-pressure gas to condense to liquid, which again passes through expansion valve 125 into coil 131 inside the chamber 130 to repeat the compression, and then condensation cycles. This process is continually performed to condition air in compartments (i.e. cool or heat) as desired.

A disadvantage of the air-conditioning arrangement illustrated in FIG. 1 is that it requires a compressor to first pressurize the refrigerant so that it becomes high-pressure, heated gas, a condenser for providing the heat exchange required to cool down the refrigerant before it passes into the coil within the refrigerant compartment, and an expansion valve. This typically requires three separate and discrete devices, one for performing each process within the air-conditioning/refrigeration cycle and interconnected by appropriate tubing. This reduces efficiency and increases component count and cost. More particularly, it is a well-established fact of thermodynamics that, at identical pressures, more energy is required to compress a gas at a higher temperature than the same gas at a lower temperature. Thus, compression with delay of heat expulsion until completion of the compression requires more energy than compression with anticipated heat expulsion during the compression. The ability to carry out this process in a more-isothermal manner, in which heat is removed from the refrigerant simultaneously with the compression, can provide a more-efficient overall process. Another disadvantage is the physical separation of the expansion valve 125 from the compressor 110, which prevents transfer of energy removed from the fluid during expansion to the compressor in order to reduce its energy demand.

Various systems have attempted to overcome this disadvantage, including providing systems having multi-stage compression components separated by intermediate cooling stages, on one hand, and systems with expansion through a turbine sharing a rotating shaft with the compressor, on the other hand. However, these systems typically require an increased number of components relative to a conventional arrangement, for example a first-stage compressor, flash chamber, heat exchanger, and second-stage compressor. These multi-stage systems have typically been limited to large-scale refrigeration systems due to the number of components (and associated higher cost) required for operation. This cost and complexity renders such systems, undesirable for smaller scale air-conditioning and refrigeration applications.

According to prior art arrangements, piston-type compressors are provided that include cooling jackets that remove heat from the compressor wall to enhance isothermalism, and/or intermediate heat exchangers between the stages of a multi-stage compressor assembly. However, these compressors operate with a reciprocating piston that does not allow sufficient physical proximity between the refrigerant under compression (inside the piston chamber) and the fluid (such as atmospheric air) used for the cooling, and only a fraction of the heat can be extracted during the compression. There is currently no available system in which a large portion of cooling (and condensation) occurs during the compression cycle to improve efficiency, particularly, one which does not involve a series of separate components that increase cost and complexity.

A further challenge in producing a fluid-handling compressor, or similar device, is to render it both fluid-tight over a long life, and straightforward to manufacture. These aspects can greatly reduce production cost and increase long-term reliability.

It is thus desirable to provide a single apparatus capable of performing simultaneous refrigerant compression, condensation, and expansion, thereby improving efficiency and overall design of air-conditioning, refrigeration and heat-pumping systems. This system should further provide the advantage of a fewer number of components for performing the required heat transfer from a cold side to a warmer side.

SUMMARY OF THE INVENTION

This invention overcomes disadvantages of the prior art by providing a combined device that incorporates an isothermal turbocompressor, a turbocondenser and turboexpander for use in a system that transfers heat from a colder side to a warmer side, for example, a refrigerant-based heat-pumping system that performs the compression and condensation of the refrigerant in an air-conditioning/refrigeration heat-exchange cycle.

In one embodiment, an exemplary isothermal turbocompressor (without turbocondenser or turboexpander stages) includes a central hub having a plurality of spokes extending radially outwardly therefrom to an outer stationary plenum. In operation, the rotating central hub directs refrigerant from an inlet feeding tube, which then flows trough at least one tube disposed in each of the spokes. The tubes direct the flow of refrigerant to the outer stationary plenum, via the centrifugal force exerted by the spinning of the central hub according to one embodiment. This applied centrifugal force also performs the compression of the refrigerant by the force exerted thereon as it is collected within the plenum.

According to another illustrative embodiment, the flow of refrigerant is directed outwardly through a spoke framework, and back inwardly to undergo centrifugal force exerted by spinning the central hub. This performs the compression and then condensation required during the refrigeration cycle.

More particularly, the outer plenum includes a circumferential groove or well that faces openings in the spokes, and from which compressed refrigerant exits the spokes and enters the plenum. Once in the plenum, the compressed refrigerant is directed to at least one externally directed outlet. The stationary inlet feeding tube of the hub and the outer plenum are joined to the spinning component by associated seals.

The spokes can define blade or fins having an appropriate aerodynamic shape and constructed from a material with good heat-transfer characteristics. The blades generate an axial and radial airflow over their surface by drawing the cooling fluid, typically air, across the device and thereby cooling the refrigerant within the spokes. The turbocompressor thus also acts as a fan, with the spokes of the compressor collectively acting as a fan, thereby cooling and thus condensing the refrigerant simultaneously while it is compressed. In this manner, a device can perform both the compression and cooling stages of a refrigerant in an air-conditioning system, and thereby provide a more-isothermal compression process as heat is withdrawn from the refrigerant via the thermal exchange between the cooling fluid and the surface of the spokes as the compression occurs. The motor that rotationally drives the spokes with respect to the inlet and plenum can be variable in speed.

In an illustrative embodiment, the isothermal turbocompressor includes a central hub mounted on a rotating shaft, driven by a motor, to thereby cause the central hub to rotate. The central hub having an inner volume receiving a flow of refrigerant from a rotationally interconnected stationary inlet. A plurality of spokes are attached to, and each extends radially outwardly from, the central hub to a rim. The spokes each define a shape that generates lift during rotation of the hub so as to direct airflow thereover. At least some of the spokes each respectively include a conduit that extends from the inner volume of the hub to a radially outward wall of the rim. A plenum is provided with a circumferential annular well in which the rim rotates. The well is constructed and arranged to collect the refrigerant in a pressurized state from each of the conduits, and the plenum includes at least one outlet located in fluid communication with the annular well.

According to an illustrative embodiment, the open framework defines a combined turbo-compressor-condenser-expander arrangement, which includes heat-transferring blades that are mounted on, or surround, individual conduits to promote air exchange and heat transfer. In operation, the open framework rotates in free air to promote heat exchange. This optimizes contact with free air during rotation. The blades are in thermal contact with the conduits in each embodiment.

In an illustrative embodiment an isothermal turbo-compressor-condenser-expander assembly includes a first plurality of spokes extending radially outwardly from a first central hub to an outer perimeter. At least some of the first plurality of spokes each includes a first radial conduit that transports refrigerant from the first central hub to the outer perimeter and a radial blade in thermal communication with the first radial conduit that promotes heat exchange radially. There is provided a second plurality of spokes extending radially outwardly from a second central hub located at an axial spacing from the first central hub. At least some of the second plurality of spokes each includes a second radial conduit that transports refrigerant from the outer perimeter to the second central hub. The second plurality of spokes include, among possibly other materials, some thermally resistant material to act as a thermal barrier. A plurality of axial conduits extend axially at the outer perimeter between the first plurality of spokes and the second plurality of spokes, and each interconnecting the first radial conduit and the second radial conduit, respectively, to direct refrigerant therebetween. At least some of the plurality of axial conduits each includes an axial blade in thermal communication with the axial conduit, which promotes heat exchange. A motor rotates a central axis (such as a solid or hollow drive/connecting shaft) operatively connected to the first central hub and the second central hub to thereby rotate the first plurality of spokes and the second plurality of spokes so that the refrigerant experiences centrifugal force to perform compression with respect to each first radial conduit and decompression with respect to each second radial conduit. The refrigerant, likewise, experiences condensation with respect to each axial conduit.

In an illustrative embodiment, the first central hub includes a precompression assembly. The precompression assembly can comprise a housing having a piston assembly in fluid communication with each first radial conduit. The driven central axis defines a hollow shaft that directs the refrigerant from an inlet adjacent the second central hub into the piston assembly so as to be precompressed by the piston assembly before entering each first radial conduit. The piston assembly can be driven, for example, by a separate motor or by a shaft that remains stationary while the housing rotates. The inlet adjacent to the second central is illustratively located on a non-rotating inlet base rotating fluid union. Likewise, the rotating fluid union includes a non-rotating outlet base, axially separated from the inlet base. The outlet base is in fluid communication with passages that surround a central passage in communication with the inlet. The passages are in fluid communication with each second radial conduit. In this manner, the inlet and outlet are both located on one end of the device. A drive pulley or other member can be mounted on the hollow shaft adjacent to the fluid union.

In a further illustrative embodiment an ITCCE bladed assembly (also sometimes termed a "fan" or "fan assembly") includes a driven central hub assembly with a first fluid coupling. A first inner plenum is in fluid communication with the fluid coupling. A plurality of compressor multiport conduits (also referred to herein as "multiport fins") extend radially, and pass fluid from, the first inner plenum to an outer plenum that acts ad an equalizing line. A return path is provided to a second outlet fluid coupling from the outer plenum. The multiport conduits can be formed as metal extrusions, including internal ribs that separate a plurality of ports formed therebetween along an entire length of the conduits. The conduits can define an airfoil shape and/or are axially twisted (i.e. twisted in the manner of a helix along a longitudinal/elongation axis thereof), generating axial airflow. The return path can include return multiport conduits. Illustratively, the compressor multiport conduits are formed as metal extrusions, and can include internal ribs that separate a plurality of ports formed therebetween along an entire length of the conduits. The ports of the multiport arrangement and either be (a) evenly spaced; or (b) unevenly spaced to define solid areas within a cross section of the each of the conduits. At least a portion of each of the compressor multiport conduits can define a symmetrical cross section. Each of two opposing ends of each of the compressor multiport conduits can define the symmetrical cross section, and each end can be mounted in a slot on each of the first inner plenum and the outer plenum. At least a portion of at least some of the compressor multiport conduits can each define an airfoil shape. Illustratively, the airfoil shape can be defined by a shroud covering an inner core having the ports. Also, at least one slot can be oriented relative to a direction of elongation of the plenum either (a) vertically, (b) horizontally or (c) at an acute angle that provides an angle of attack to the conduit blade with respect to oncoming air. At least some of the compressor multiport conduits can axially twisted along a radial length of thereof so they are attached to the first plenum at a first orientation and to the second plenum at a second orientation. The first orientation and the second orientation can be transverse and/or perpendicular relative to each other. The multiport conduits can also define a pair of stacked blade elements each defining a multiport cross section. The return path can include a plurality of return multiport conduits that extend downwardly from the outer plenum and include a bend that directs the return multiport conduits radially inward to a second inner plenum in communication with a second fluid coupling of the driven hub assembly, and at least some of the return multiport conduits can define a axial twist in the form of a helix along at least a portion of the longitudinal/elongated axis thereof. In embodiments, the inner plenum can define a multichannel structure, and the multichannel structure can include a plurality of vertically oriented slots for receiving ends of the multiport compressor conduits, wherein a plurality of ports are in fluid communication with each channel of the multichannel structure. The outer plenum can define a smaller cross sectional area than the first inner plenum so as to decrease fluid volume therein. The multiport conduits can include a first multiport structure and a second multiport structure in thermally conductive engagement with each other, arranged so that fluid flows in a first radial direction in the first multiport structure and in a second, countercurrent and/or co-current radial direction in the second multiport structure. It is contemplated that embodiments can include both countercurrent and co-current flow—for example where, instead of a radial arrangement (exclusively), the flow pattern arrangement includes crossflow with one progressively spiraled and one exclusively radial structure. Such structures can be thermally interfaced in a counterflow or co-current flow configuration. In a further option, the central hub assembly can include cross flowing fluid passing therethrough in a pair of paths that collectively define a coaxial arrangement, and further comprising insulation between each of the paths. Illustratively, the central hub assembly can include a precompression assembly.

In another embodiment, the bladed assembly comprises a driven central hub assembly with a first fluid coupling; a first inner plenum in fluid communication with the fluid coupling; a plurality of compressor conduits extending radially and passing fluid from the first inner plenum to an outer plenum, that bridges a fluid path between the compressor conduits; and a return path to the fluid coupling from the outer plenum.

BRIEF DESCRIPTION OF THE DRAWINGS

The invention description below refers to the accompanying drawings, of which.

DETAILED DESCRIPTION

In accordance with an illustrative embodiment, there is provided an isothermal turbocompressor (with or without an associated turbocondenser and turboexpander) for use in a refrigerant-based air-conditioning system. The system may be implemented for a variety of uses, including a refrigerator, air conditioner, heat pump, and other heating or cooling systems using a compressible refrigerant. The turbocompressor may also be used for the purpose of a more-energy-efficient method for compressing a gas prior to transportation by pipeline or by container. In such cases, the transported gas is broadly termed herein as "refrigerant", and may be cooled without necessarily changing phase to a liquid. The device is termed a turbocompressor, because it compresses the refrigerant (gas, etc.) via the rotation of a wheel-like spoked turbo fan that will be described in detail below. Likewise, the optional additional components termed a "turbocondenser" and "turboexpander" are called such because they accomplish condensation and expansion, respectively using a rotating apparatus.

I. STATIONARY PLENUM TURBOCOMPRESSOR

Figure 1:
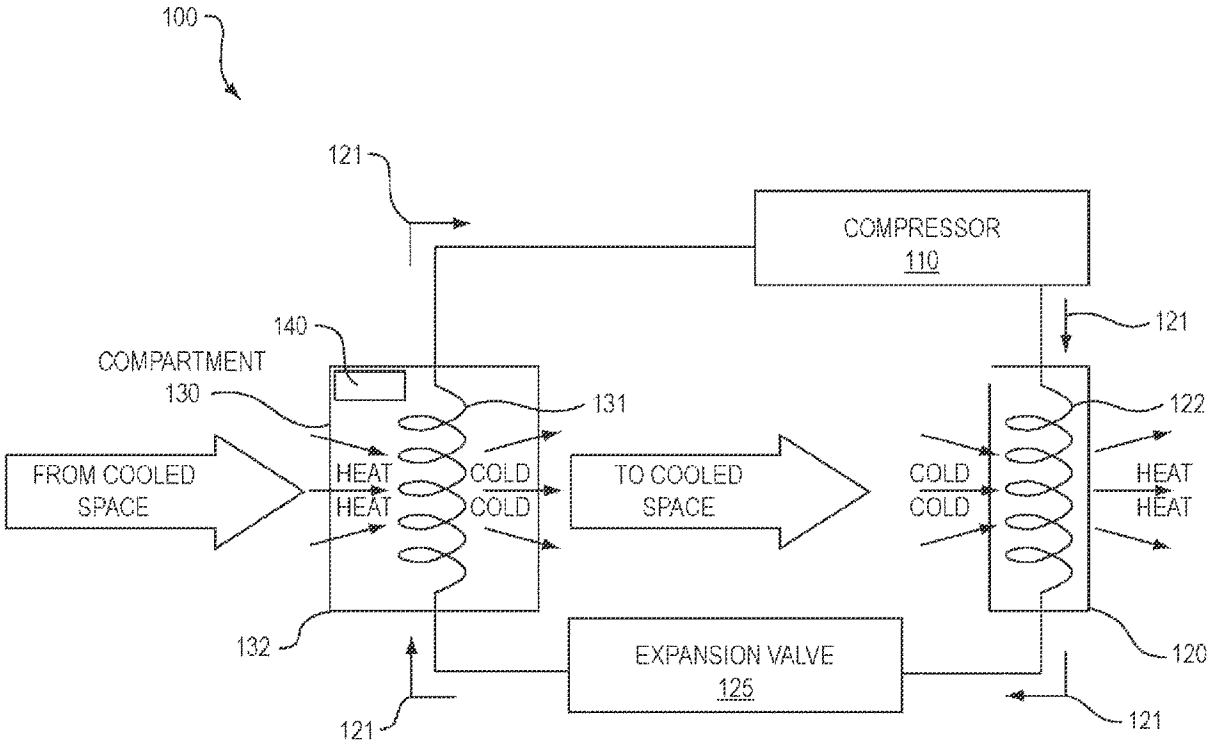
FIG. 1 (PRIOR ART)
FIG. 1, already described, is a block diagram of an air-conditioning system comprising a compressor and a condenser according to a prior art arrangement.
Figure 2:
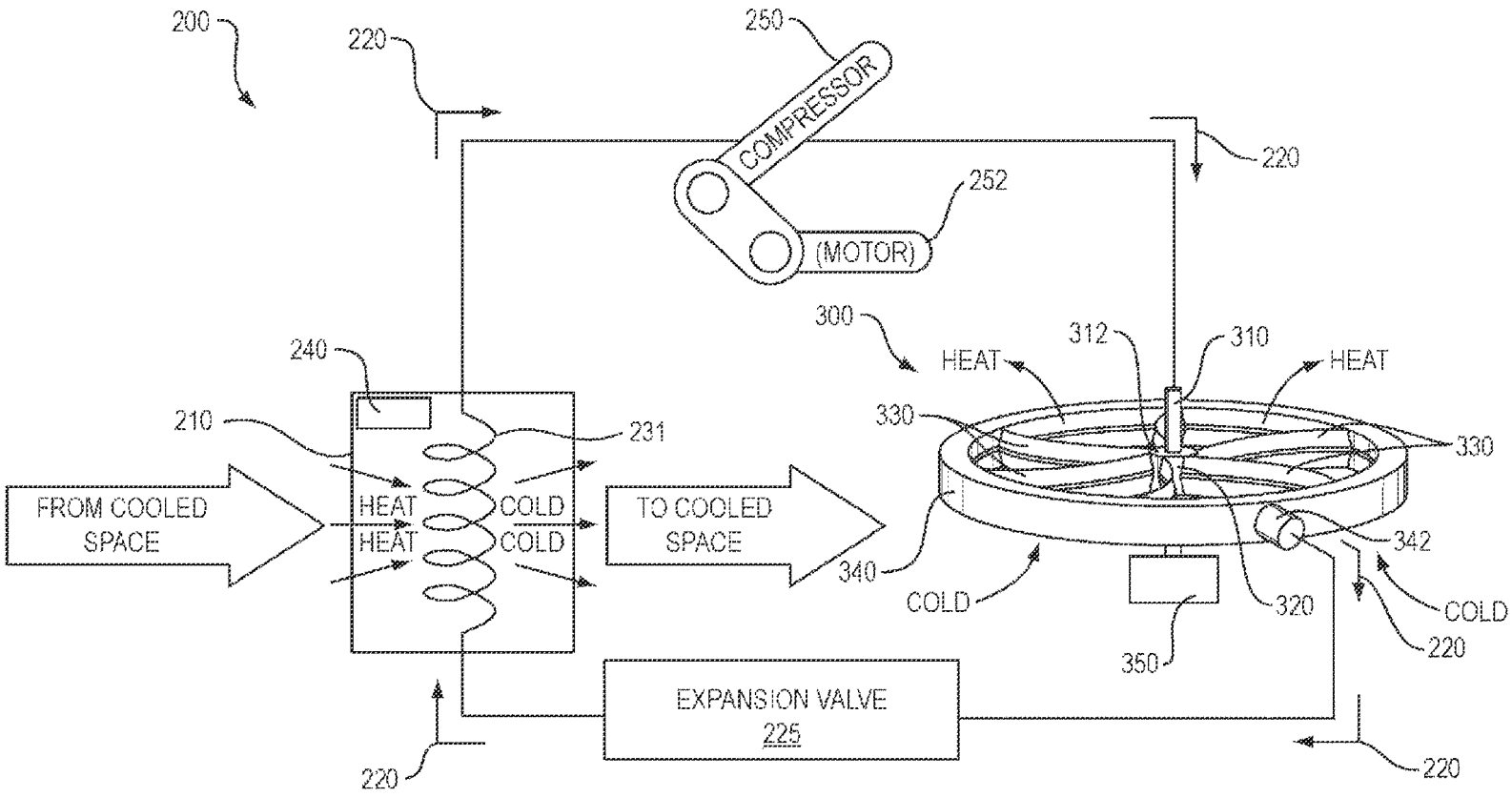
FIG. 2 is a block diagram of an air-conditioning/heat-exchange system including an isothermal compressor according to an illustrative embodiment.

FIG. 2 is a block diagram of an exemplary air-conditioning/cooling system loop 200 comprising a precompressor 250, an isothermal turbocompressor 300, an expansion valve 225 and an evaporator 210, connected sequentially by conduit 220. The precompressor 250 performs compression until the temperature of the refrigerant fluid rises to that of the warm compartment, typically that of the outside atmosphere. The isothermal compressor 300 completes the required compression while subjecting the refrigerant to simultaneous cooling (with possible condensation), keeping the temperature of the refrigerant close to that of the outside atmosphere. From the expansion valve 225, the expanded refrigerant then enters the compartment 210 where a flow ambient air (or another fluid) is passed through the compartment 210 possibly using a fan 240 or other source of flow. As described above, the fan 240 or possible other source of flow directs the air/fluid over coils 231 within the loop or circuit 200 to exchange heat from the air/fluid with the refrigerant as shown. Notably, the conventional compressor/condenser arrangement such as that illustrated in FIG. 1 (110), employing two devices in sequence to perform the two heat-transfer operations separately in a continual cycle (flow arrows 220) through the loop 200, has been substituted with a precompressor 250 and an isothermal turbocompressor 300 according to an illustrative embodiment. In operation, the (higher-heat) refrigerant, in its gaseous form, flows through the precompressor 250 and, in a partially compressed state, enters isothermal turbocompressor 300 via a stationary inlet tube 310, as described in greater detail below, with reference to FIGS. 3 and 4. The isothermal turbocompressor 300, as will be described in greater detail below, performs additional compression via centrifugal force exerted on a set of spokes spinning under the drive of an electrically (or other form of motive power) driven motor 350. Such compression occurs within the spokes 330 after refrigerant is relatively evenly distributed thereinto via the hub 320. The motor 350 can be single speed, multi-speed, or variable speed as appropriate. Likewise, the size and power of the motor is highly variable.

Notably, the isothermal turbocompressor 300 is constructed and arranged such that it also performs the cooling, which may or may not include associated condensation, by drawing air or other cooling fluid across the device. In this manner, the fluid output 220 of the isothermal turbocompressor 300 is a cooled, elevated-pressure refrigerant, similar to the output of a conventional compressor and condenser (110 and 120 of FIG. 1) combination, but accomplished using the precompressor 250 and isothermal turbocompressor 300, as opposed to a more-energy demanding compressor 110 and a separate device for performing the condensation of refrigerant in an air-conditioning system.

The precompressor in this embodiment can comprise an axial piston refrigerant compressor that is driven via a belt or other power transmission using a separate motor 252, or a drive assembly interconnected with the turbocompressor 300. The structure or the precompressor is highly variable. As will be described below, the precompressor can be integrated with the turbocompressor in various embodiments.

Figure 3:
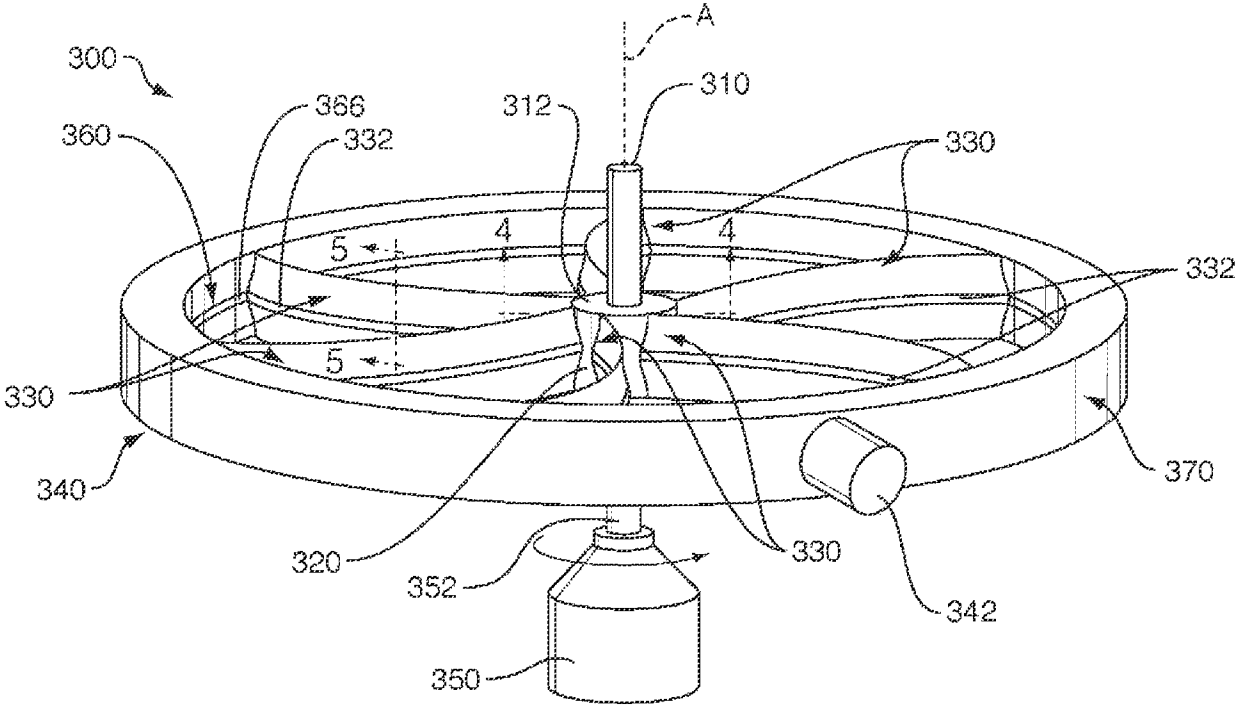
FIG. 3 is a more detailed perspective view of the isothermal compressor according to the illustrative embodiment.

More particularly, as shown in FIG. 3, which is a perspective view of the isothermal turbocompressor 300, the refrigerant flows under mass-flow pressure (initially generated by action of the precompressor and carried through the fluid loop) through an inlet tube 310 having a stationary, non-rotating inlet cap 312. The refrigerant collects in a central hub 320 that defines the rotating component of the isothermal turbocompressor 300. The inlet cap 312 and the central hub 320 have an appropriate seal therebetween (not shown in FIGS. 3 and 4) to prevent leakage of the refrigerant to the exterior, as will be described in greater detail below with reference to FIG. 8, which details the central-hub sealing components of the isothermal turbocompressor.

The isothermal turbocompressor 300 of the present embodiment further includes a plurality of spokes 330 extending radially outwardly from the central hub 320, that terminate at a shared circumferential (circular) rim 366 that affords the rotating component (hub 320, spokes 330 and rim 366 the general appearance of a spoked wheel. As shown, the illustrative wheel defines six spokes 330 that radiate outwardly from the central hub 320 at equal circumferential increments. However, in alternate embodiments the number of spokes is highly variable, and can depend, in part, upon the volume of airflow desired to achieve the cooling of the refrigerant during the air conditioning process. Likewise, a greater volume of refrigerant can be directed through an increased number of spokes. The movement of refrigerant through the spokes is now further described.

In this embodiment, the spokes 330 each define a spiral shape, when taken in plan (top or bottom) view. In alternate embodiments, they can define a straight or segmented shape, among other possible shapes, including three-dimensional shapes. By three-dimensional, it is meant that the spokes can deviate in part above and below a plane perpendicular to the rotational axis. As described further below, each of the spokes 330 supports at least one conduit, i.e. a tube or hollow passage 332 through which the refrigerant flows from the central hub 320 to an exterior plenum 340, where it is collected (described below), and then is expelled (under pressure) from the stationary plenum via an outlet tube 342.

The above-described electric motor 350 drives a shaft 352, and can be directly driven, or be part of a geared transmission. The shaft 352 rotates the central hub 320 (and thus also the interconnected spokes 330 and their outer rim 366). In operation, the rotation of the shaft 352 causes the central hub 320 and spokes 330 to spin, and the centrifugal force exerted on the central hub 320 and the spokes 330 thereby causes the refrigerant within the central hub to be outwardly driven through the tube or passage 332 in each of the spokes 330. The outward driving force thereby pressurizes the refrigerant (i.e. providing the compression stage of the cycle) at the plenum 340.

The spokes 330 can be formed in accordance with a spiral curve so that the angle at which the spoke attaches at the circumferential rim 336 can cause the circumferential (azimuthal) component of the velocity of the exiting refrigerant to negate, totally or partially, the rotational speed of the rim at that point. In this arrangement, the velocity of the refrigerant at the point of its entrance into the plenum is nearly radial and the kinetic energy associated with the unproductive circumferential speed is reduced or eliminated.

Figure 4:
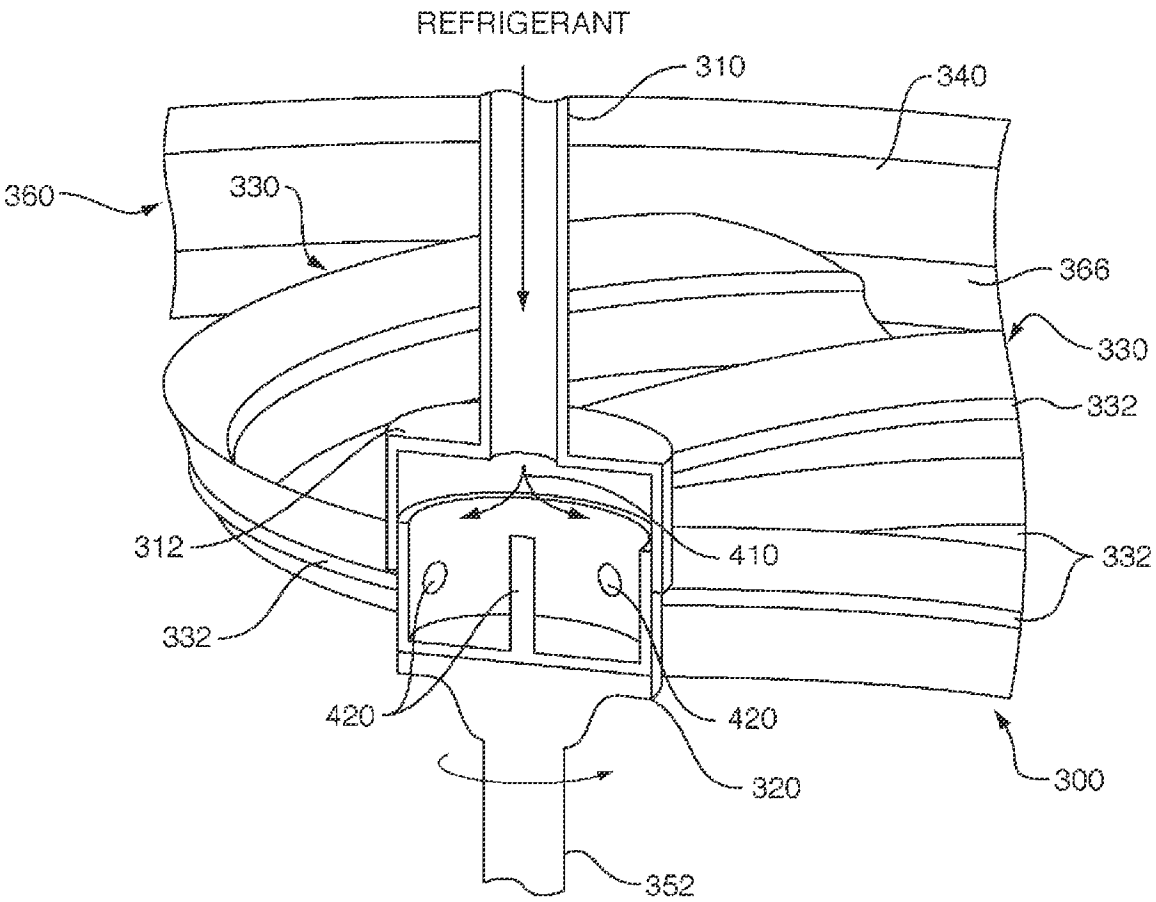
FIG. 4 is a cross-sectional view detailing a central hub of the isothermal compressor according to the illustrative embodiment, as taken along line 4-4 of FIG. 3.

With further reference to the passage of refrigerant from the inlet cap 312, into the spokes 330, FIG. 4 is a cross-sectional view of the stationary inlet cap 312 and rotating central hub 320 of the isothermal turbocompressor 300, as taken along line 4-4 of FIG. 3. The refrigerant enters the central hub 320 via an inlet tube 310 from the system's refrigerant loop (FIG. 2). In general, the turbocompressor drives the mass flow of refrigerant through the loop so as to provide a continuous flow cycle. From the inlet tube 310, the refrigerant enters the inner volume of the central hub 320. As described below, a rotational mechanical face seal (omitted in FIG. 4, but described in FIG. 8 below) between the hub 320 and inlet cap 312 prevents leakage of refrigerant to the environment from the inner volume of the hub 320 as it rotates with respect to the inlet cap 312. While a rotating mechanical face seal is employed (see FIG. 8) in an illustrative embodiment, any appropriate sealing technique can be employed to seal the refrigerant within the central hub 320 (and inlet cap 312).

As further illustrated in FIG. 4, the motor drive shaft 352 rotates the central hub 320 at a predetermined rate, and thus spins the attached, radially outwardly directed spokes 330. The spinning of the central hub 320 causes a centrifugal force to be applied to the refrigerant therein, which thereby causes the refrigerant to flow radially out of the central hub, in a direction of the arrows 410, through the holes or ports 420 in the hub wall. The holes or ports 420 respectively interconnect with each spoke conduit (i.e. the tube or passage 332) so that the refrigerant flows radially outwardly through each tube or passage 332.

Figure 5:
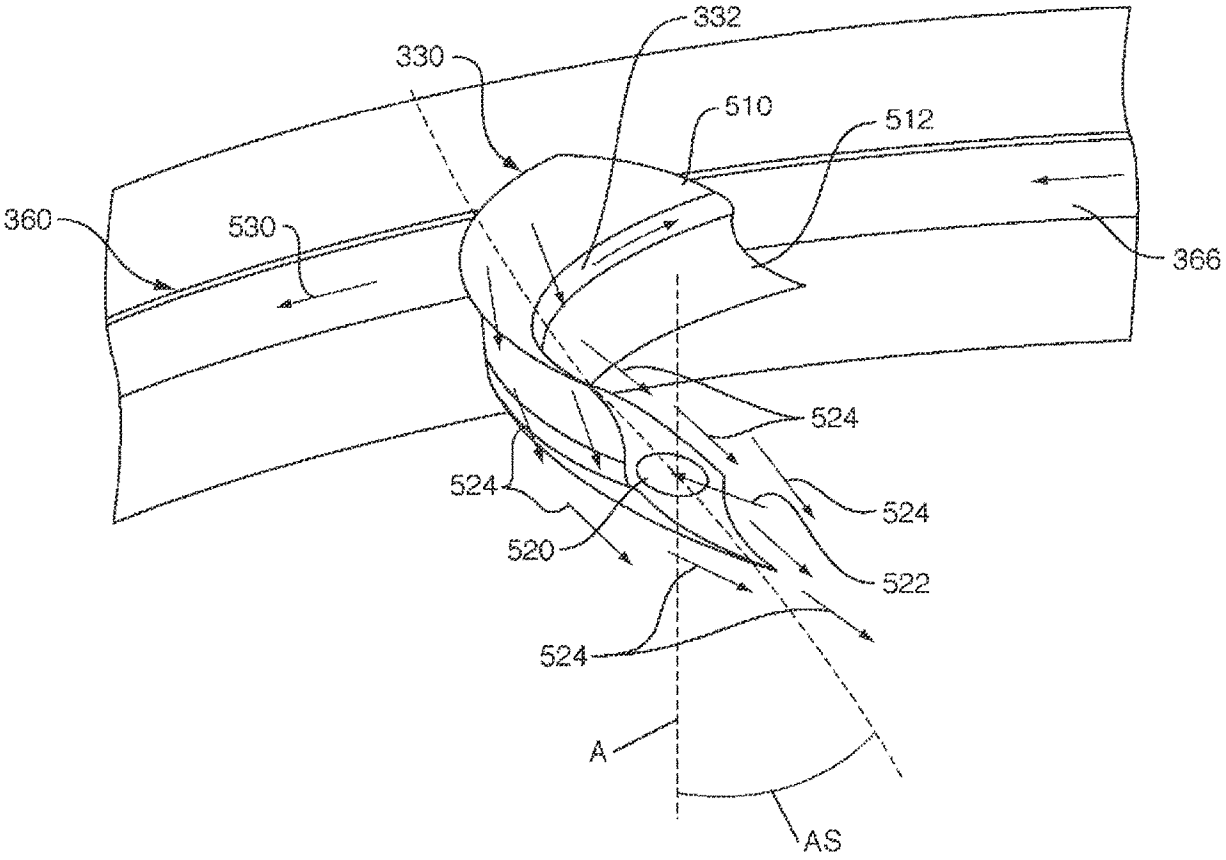
FIG. 5 is a cross-sectional view detailing a spoke of the isothermal compressor according to the illustrative embodiment, as taken along line 5-5 of FIG. 3.

As described in greater detail with respect to the cross-sectional view of FIG. 5, the spokes 330 each define a cross-sectional shape that includes a top blade section (or "top blade") 510 and a bottom, oppositely directed bottom blade section (or "bottom blade") 512, that together generate movement of the ambient air (airflow) via aerodynamic lift as the spokes are rotated. This airflow thereby draws air across the spokes of the isothermal turbocompressor in the manner of a fan as the motor 350 drives the hub 320. The airflow, having a temperature that is generally lower than that of the compressing refrigerant, causes the refrigerant to cool and possibly change phase to a liquid as it transfers heat to the cooler air drawn across it (i.e. the refrigerant can undergo a condensation cycle) in the depicted direction according to the arrows 524.

Note, as used herein, terms such as "up", "down", "side", "top", "bottom", "inside", "outside", and the like, are meant as conventions only and not as absolute directions/orientations. Also, the ambient air may be replaced by another fluid, including gas or liquid, suitably chosen to perform the cooling action.

The refrigerant flows through the hollow passage 520 of the depicted tube 332 (arrow 522) based on the rotationally induced centrifugal force. The spokes 330 are constructed and arranged such that they have an upper blade portion 510 and a lower blade portion 512 with the thickened central region containing tube 332 therebetween that together form a blade-like structure that, when in rotation, acts as a fan blade. The upper and lower blade portions 510 and 512 collectively form a slanted blade that generates lift, thereby impelling atmospheric air or another ambient fluid in the space between the spokes 330. The blade generally assumes a non-parallel and non-perpendicular (slant) angle AS with respect to the hub's rotational axis A (see also FIG. 3). This slant and cross-sectional geometry of the airfoil-like blade structure (along with the rotational speed of the hub) controls the volume of airflow (arrows 524), that is drawn past, and in contact with the spokes 330 to thereby conduct a certain amount of heat from the refrigerant passing within the tubes 332. The blade slant angle AS is highly variable, as is the cross section geometry of the blade. Also, while a tube 332 is located at the central region in this embodiment, it is expressly contemplated that the tube or other conduit(s) can be located more-adjacent to an upper or lower edge of the blade/spoke. For example, the tube can be placed closer to the leading edge of the airflow in an alternate embodiment.

The arrow 530 shows the exemplary rotation of the spokes 330 and rim 366 relative to an annular well 360 of the stationary plenum 340. This rotation, combined with the structure of the blade shape of the spokes 330, provides for the depicted airflow down and past the spokes. In this manner, the refrigerant transfers its heat to the cooler air that is being drawn toward the spokes by their rotation. In other words, the slanted, airfoil-shaped spokes 330 act as fan blades that can be rotated to provide a continuous flow of cooler air in contact with the surface thereof.

Figure 6:
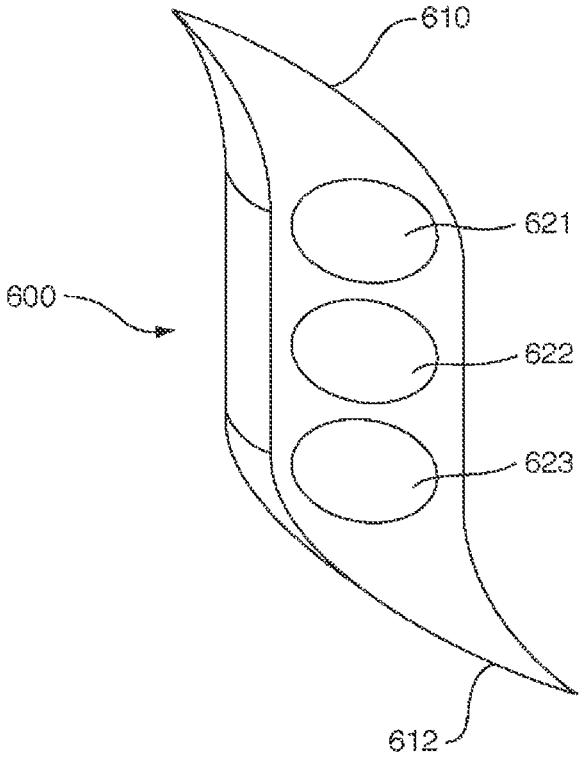
FIG. 6 is a cross-sectional view detailing a spoke of an isothermal compressor according to an alternate embodiment including a plurality of parallel tubes therein.

In alternate embodiments, it can be desirable to provide each spoke of the isothermal turbocompressor 300 with a plurality of oblong passages or tubes formed within its cross sectional structure. Providing a plurality of tubes or passages provides more contact area for the refrigerant with respect to the spoke's surface, and thereby increases the amount of heat transfer during compression. FIG. 6 shows a cross-sectional view of a multi-tube spoke 600 according to an alternate embodiment. As shown, the spoke defines an upper blade portion 610 and a lower blade portion 612, which each taper in opposing directions to generate lift during rotation. This lift draws air across the blades as described above to thereby cool the refrigerant. The blade portions 610, 612 can define any shape, but illustratively extend in opposing directions as identical, mirror-imaged airfoils as shown. An asymmetric airfoil that optimizes air movement in a given direction can be provided in alternate embodiments hereto. The cross-sectional shape of the spoke/blade 330, 500 in the embodiments herein can be angled in an opposing direction so as to direct airflow in an opposing direction for a given rotational direction.

Notably, the illustrative spoke 600 includes a plurality of tubes or passages 621, 622 and 623 within its cross section through which refrigerant flows to undergo the compression cycle of an air conditioning or refrigeration process. As described, a plurality of tubes potentially increases the cross sectional area of the overall refrigerant conduit in each spoke without overly increasing the thickness of the spoke's blade geometry (and thereby reducing its lift properties or increasing its aerodynamic drag). This allows for greater refrigerant surface area in contact with the heat-conducting surface of the spoke and a higher refrigerant mass flow rate, or alternatively a slower flow of refrigerant at equal overall mass flow rate, thereby increasing the isothermal turbocompressor's cooling capacity and its degree of heat transfer. In general, this multi-tube arrangement can permit the given flow volume of refrigerant to transfer increased heat when compared to a single passage/tube embodiment to thereby further improve compressor efficiency. Additionally, if several passages are provided through each spoke, then these tubes can define varied diameters or varied cross-sectional shapes within the same spoke (for example, a larger circular tube in the center flanked by a pair of smaller elliptical passages—one smaller passage located adjacent to each blade edge). A multi-tube blade can also be customized for particular applications by varying the number of tubes provided within each spoke. That is, in some embodiment, two tubes can be employed, in other embodiments, 4 or 5 tubes can be employed (for example). The cross section shape and overall area of an individual tube or passage can also vary along its length along the spoke, being, for example, wider near the entrance and progressively narrower down the length of the spoke to concentrate the fluid as it becomes pressurized.

It should be clear that a wide range of possible passage shapes and arrangements can be defined within the walls of the spoke. Likewise a variety of flat shapes, symmetrical airfoils and asymmetrical airfoils with tan appropriate slant angle (or range of slant angles) can be employed. In general, internal passage shapes that allow greater contact between the fluid and the surface area of the passage, and/or those that provide a thinner wall between the cooling fluid and the fluid are often desirable to increase heat transfer. In further embodiments, the spokes can define a variable geometry in the manner of a variable-pitch aircraft propeller to increase or decrease airflow (and heat transfer) for a given motor rotation rate. Electromechanical actuators, steppers, servos or solenoids operatively connected to the hub and/or the rim can effect the change in pitch/slant angle. Other devices, such as intake or outflow louvers, placed in line with the turbocompressor's air/fluid flow can also be used to vary the flow across the spokes.

Referring again to FIG. 3, the outer rim 366 that surrounds the spokes 330 rides within a circumferentially annular well or groove 360 of a circular, stationary plenum 340 of the isothermal turbocompressor 300. The pressurized refrigerant exits the spokes 330 via through-holes or ports in the rim 366, shown in greater detail in the cross section of FIG. 7. The refrigerant flows from the through-holes 730 to be collected in the stationary plenum 340 at an annular conduit 720 that forms a radial-outward coaxial extension of the annular well 360. The through-holes or ports 730 are typically provided in numbers and shapes that accommodate the number and shapes of passages at their terminal point of the spokes (according to the various geometries contemplated herein), in order to provide smooth passage of the refrigerant into the plenum 340. The cross-sectional shape of the annular conduit 720 that receives refrigerant from the through-holes 730 is also highly variable, and by way of example, is depicted as a rectangular cross section.

The illustrative annular well 360 of the stationary plenum 340 defines a height HW that is sufficient to allow the height HR of the rim 366 to rotate within the stationary plenum 340. Appropriate mechanical face seals are used to prevent refrigerant loss as the rim 366 rotates with respect to the plenum 340, as will be described in greater detail below with reference to FIG. 9. The high-pressure, cooled refrigerant exits the stationary plenum 340 via at least one outlet tube (the above-described outlet 342 shown in phantom in FIG. 7) located along the plenum's outer wall 370, or another plenum wall (e.g. the top and/or bottom plenum walls), and in fluid communication with the conduit 720. The pressurized, cooled refrigerant can thereafter be drawn through an expansion valve (225) that reduces its pressure and temperature, such that the refrigerant may absorb the warm air within a compartment as performed in conventional air-conditioning and other cooling systems. Note, in an alternate embodiment, the pressure-reducing expansion valve may be incorporated in the isothermal turbocompressor (for example, as a component placed along outlet tube 342 or components affixed to each of the several through-holes 730 along the rim 366).

As described below in greater detail, with reference to FIG. 9, the rim 366 is sealed within the stationary plenum 340 using an accompanying rotating mechanical face seal therebetween so as to retain the pressurized refrigerant within the well 360 and circumferential conduit 720 of the stationary plenum 340.

Note that the spokes 330, hub 320 and rim 366 can be constructed from a material as a unitary fan/wheel structure (for example, an aluminum casting), or from a plurality of materials that are assembled together to form the fan structure. In general, the blades are desirably constructed from a material with relatively high thermal conductivity, such as metal. Other components, such as the rim 366, can be constructed from other materials where appropriate, such as a composite. However, the material choice for the fan and other elements of the turbocompressor is highly variable. Such materials are generally selected for cost, ease of working, ability to withstand pressure and mechanical stress (for example, the stresses imparted by centrifugal force), durability, and thermal properties.

Figure 8:
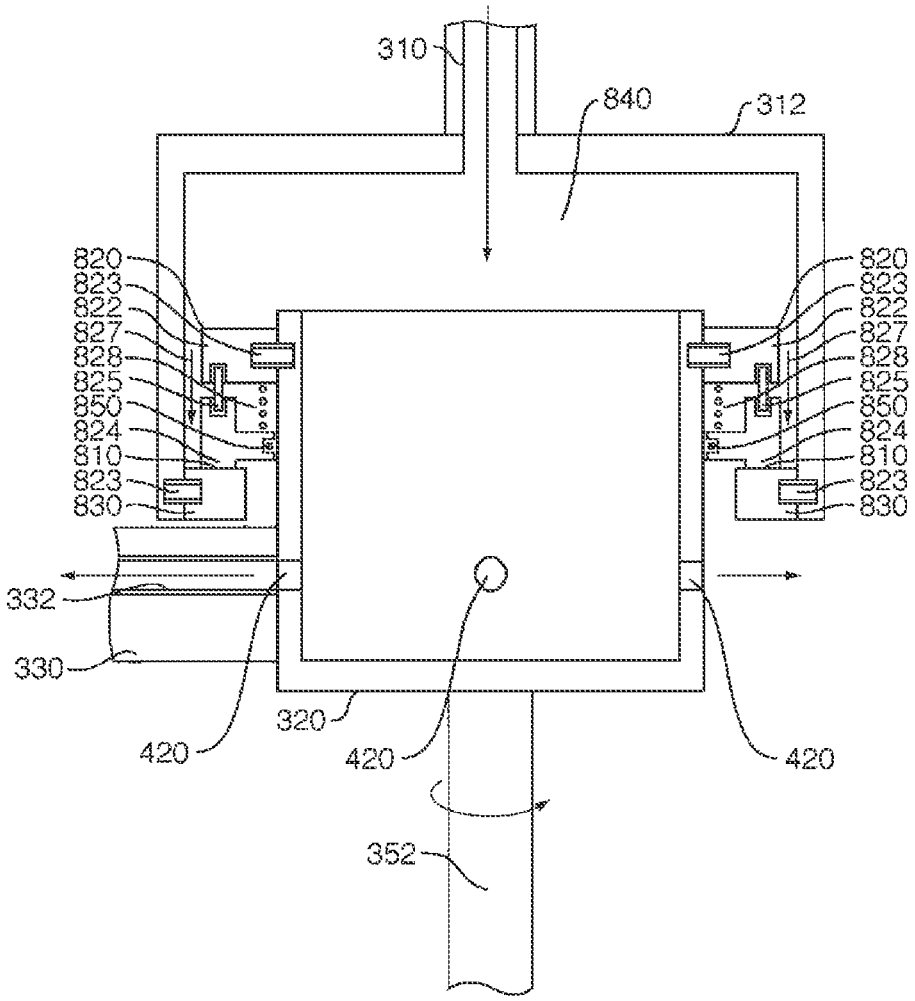
FIG. 8 is a more-detailed illustration of the cross-sectional view of FIG. 4, showing exemplary sealing components according to an illustrative embodiment.
Figure 9:
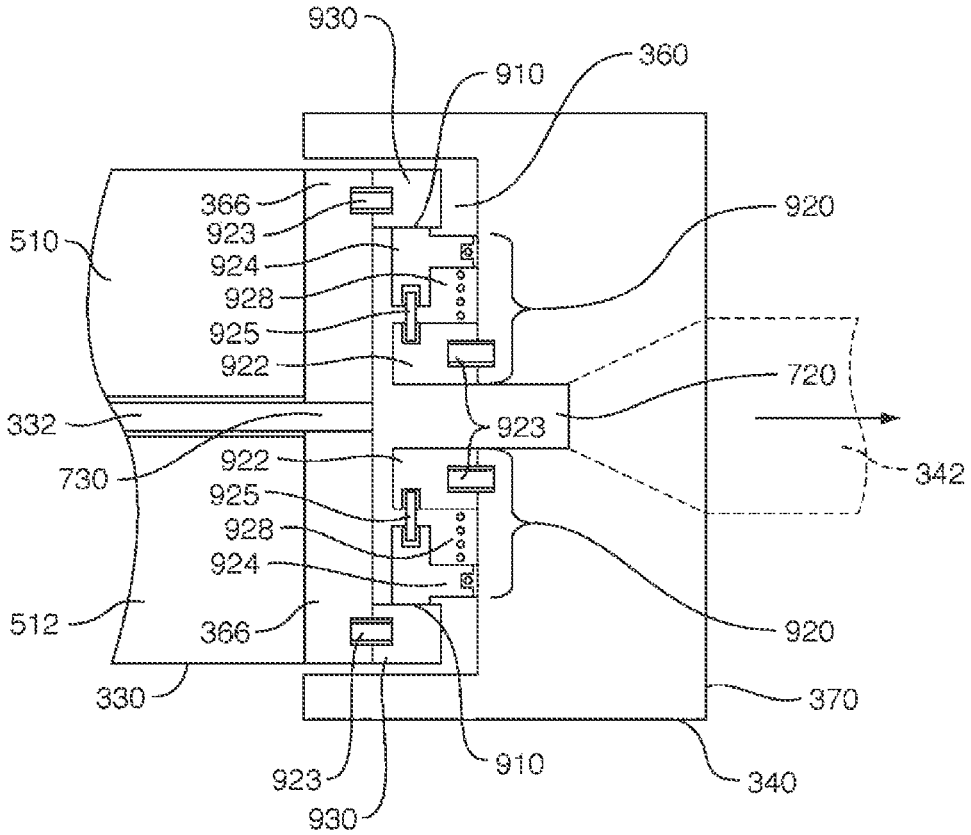
FIG. 9 is a more-detailed illustration of the cross-sectional view of FIG. 7, showing exemplary sealing components according to an illustrative embodiment.

FIGS. 8 and 9 detail rotational seals provided, respectively at each of the hub 320 and the plenum 340 according to an illustrative embodiment of the isothermal turbocompressor 300. As shown, the illustrative seals are known generally to those skilled in the art as mechanical face seals. Mechanical face seals generally comprise seals that employ a spring-loaded/fluid-pressure-biased primary ring, as will be described, and a mating ring, to provide a slidable sealing surface therebetween which serves to maintain pressurized liquids and/or gases from leaking away from the volume in which they must remain confined. In general, the axially-movable primary ring is secured to one rotating member while the mating ring is axially fixed, and secured to the opposing rotating surface. The primary and mating rings confront each other along a circumferential sealing face that defines a relatively low-friction, sliding interface therebetween. One ring may be constructed of a softer material than the other to prevent abrasion that can eventually cause fluid leakage through the interface. The primary ring is typically biased toward the interface by a spring to maintain the seal while the components are stationary (non-rotating), and is arranged so that increased fluid pressure forces the primary ring to bear more forcibly against the mating ring to enhance the seal at higher pressures. By way of further background mechanical face seals, for use according to illustrative embodiments herein are shown and described in, *PRINCIPLES AND DESIGN OF MECHANICAL FACE SEALS*, by Alan O. Lebeck (1991). This reference should provide a general guide to the reader on the construction of a variety of commonly employed mechanical face seals for use in rotating assemblies, which require fluid to be maintained within the enclosed space between the rotating components.

FIG. 8 is a more-detailed illustration of the cross-sectional view of FIG. 4, showing exemplary sealing components located between the rotating central hub 320 and the stationary inlet cap 312. The primary ring 820 is fixed about the central hub 320 and provides compensation and flexibility to allow for small relative axial and angular motion of the relative parts. The primary ring 820 comprises a base ring 822 that is fixed about the central hub 320 (as shown by the fasteners or pins 823 denoting attachment to the adjacent structure) and a primary seal ring 824. The fixed components can be attached by any acceptable attachment mechanism. The primary ring 820 is generally sealed from infiltration via a flexible annular cover 825 that extends between the base ring 822 and the seal ring 824 so as to cover a series of biasing springs 828 therebetween equally spaced around the circumference of the central hub 320. The primary ring 820 is biased by the springs 828 in a downward direction (arrow 827) to create the sealing surface 810 between the primary ring 820 and the mating ring 830. The mating ring 830 is, thus, fixedly attached (by exemplary pins 823) to the inner surface of the stationary inlet cap 312. As shown, a planar, annular sealing surface 810 is thereby provided between the biased primary ring 820 and a mating ring 830. The springs 828 bias the seal ring 824 of the primary ring 820 into contact with the mating ring 830 to seal the refrigerant within the isothermal turbocompressor and to prevent potential leakage while the components are stationary. As loop pressure is generated during compressor operation, the arrangement of the seal ring 824 with respect to the volume space 840 causes the pressure to bias downwardly (arrow 827) on the seal ring 824, so as to increase its engagement pressure against the mating ring 830. Note that a secondary seal (O-ring 850) can be provided against the outer wall of the hub 320. This seal 850, along with the flexible connection between the base ring 822 and sealing ring 824, allows for small axial and radial movement of the hub and inlet cap with respect to each other.

The mechanical face seal arrangement, as shown in FIG. 8, allows the rotating central hub, as fixed on the shaft 352, to rotate within the inlet cap 312, while sealing the refrigerant therein. A similar mechanical face seal arrangement is provided to seal refrigerant collected within the stationary plenum 340, as the rim 366 rotates therein, which is now described in further detail.

Figure 7:
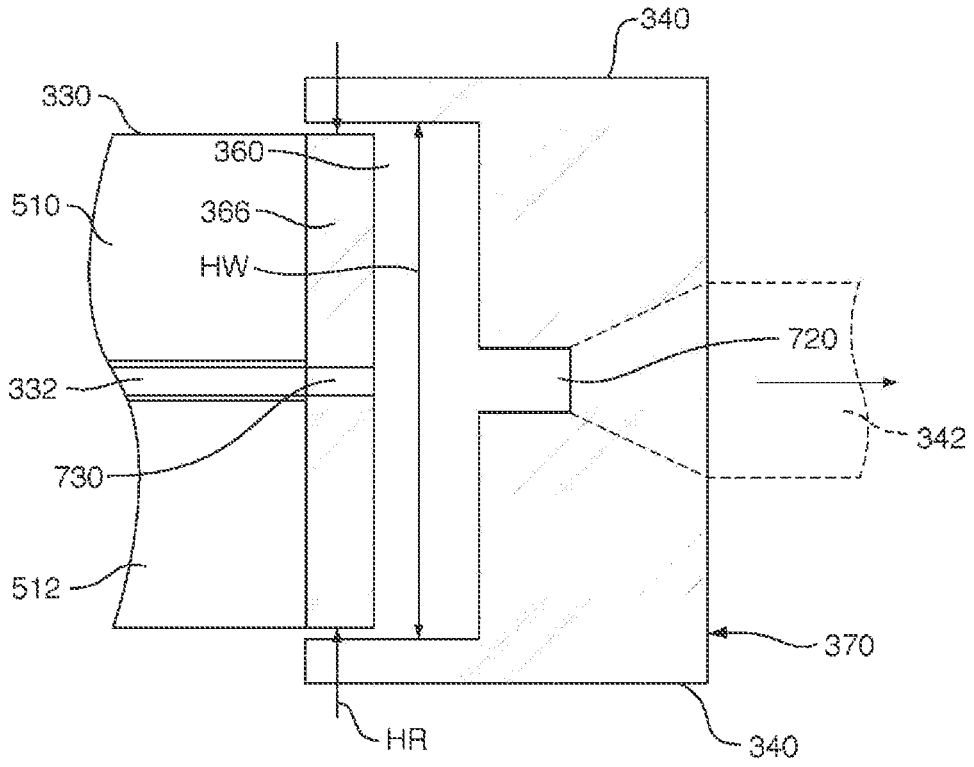
FIG. 7 is a cross-sectional view detailing the junction between a spoke and a stationary plenum of the isothermal compressor according to the illustrative embodiment.

FIG. 9 is a more-detailed illustration of the cross-sectional view of FIG. 7, showing exemplary sealing components that provide a sealing surface 910 between the rim 366 and the circumferential annular well 360 of the stationary plenum 340. In an illustrative embodiment, the exemplary sealing mechanism employed between the rim 366 and the well 360 is also a rotating mechanical face seals, similar to that described with reference to FIG. 8 above. However, any acceptable seal that allows for the containment of fluid under pressure while a pair of components rotate with respect to each other can be employed in alternate embodiments As shown, a pair of opposing mechanical face seals is employed between the rim 366 and the well 360. Each of these seals includes a primary ring 920, comprising a fixed base ring 922, which is attached to the stationary plenum 340 (pins 923). The primary ring 920 further comprises an axially movable seal ring 924 which contacts the mating ring 930, fixed to the ring 366, to seal the refrigerant within the stationary plenum. The primary ring 920 is sealed with a cover 925 to resist infiltration of the refrigerant therein, and further comprises a spring 928 (or multiplicity of discrete springs positioned about the circumference), which biases the primary seal in a direction against the mating seal 930.

The mating ring is attached to the ring 366 (pins 923), and provides for the slidable seal interface 910 so as to prevent unwanted leakage of the refrigerant from the stationary plenum. This seal is highly desirable to retain the refrigerant in the stationary plenum so that it may be directed out of the stationary plenum via outlet tube 342, such that it may be employed by an air-conditioning or other cooling, heat-pumping, or heat-exchange arrangement.

Note that the mechanical face seals depicted are only meant to show an example of a possible seal arrangement for use with the components of this embodiment, and any acceptable technique known to those of skill in the art for appropriately sealing the refrigerant within the compressor at its points of motion is expressly contemplated. Seal arrangement other than, or in addition to, the depicted mechanical face seals are expressly contemplated. Likewise, while not shown, the hub 320 and the rim 366 can each be supported by appropriate bearing structures that ensure an aligned and low-friction rotation between these elements and the respective stationary components (inlet cap 312 and plenum 340). In general a variety of bearing structures and/or sealing mechanisms can be provided between the inlet cap 312 and plenum 340. Implementations of such bearing structures and/or sealing mechanisms should be clear to those of ordinary skill in the art.

Figure 10:
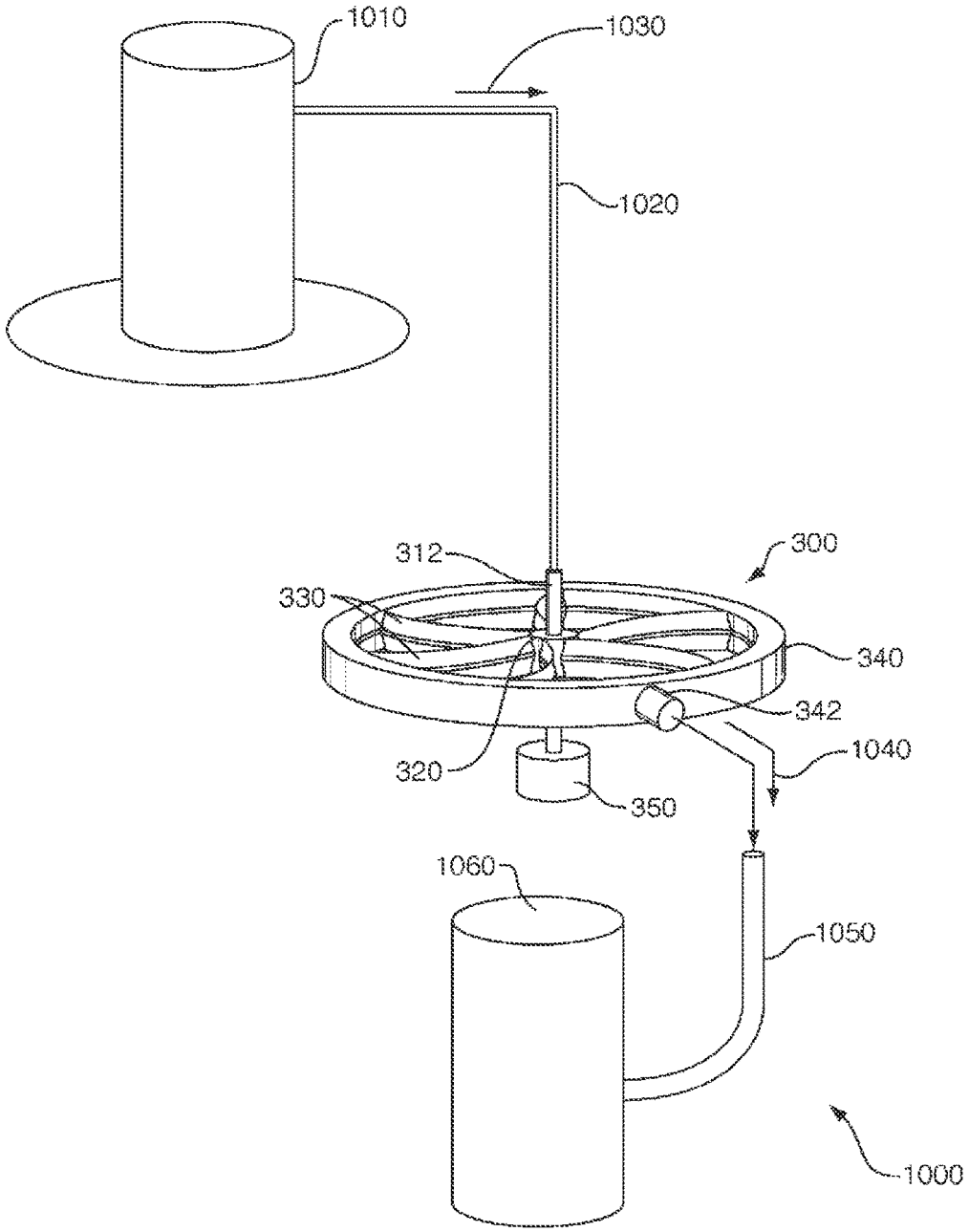
FIG. 10 is a schematic diagram of an illustrative point-to-point fluid circuit in which the turbocompressor is employed to cool and pressurize a gas.

With reference now to FIG. 10, the illustrative turbocompressor 300 is shown installed in a non-cyclical fluid circuit 1000. In this example, the (simplified) circuit 1000 is a natural gas pipeline that originates at a gas source (either a well or terminal) 1010 and extends to the illustrative turbocompressor 300 (sized and arranged appropriately to a gas pipeline application) via a pipe or conduit 1020 through which the gas flows (arrow 1030). The turbocompressor 300 is operated to increase the incoming gas' pressure, while simultaneously cooling it in an isothermal, or near-isothermal process so that it can be more-efficiently transferred (arrow 1040) from the compressor outlet 342 to a pipeline 1050. The exemplary pipeline 1050 directs the cooled (but typically non-liquefied) and pressurized gas to a storage tank 1060 or other destination. It is contemplated that a variety of intermediate valves, conduits, devices, and the like can be interposed between the source (1010) and destination (1060), including additional turbocompressor stages. This example is one of a variety of non-refrigeration-based applications in which the illustrative turbocompressor of this invention can be employed. Thus, as used herein and as described above, the term "refrigerant" is taken broadly to include a cooled gas transported through the turbocompressor in a point-to-point circuit.

More generally, while the turbocompressor of this invention is well-suited to applications such as domestic or automotive air-conditioning, heat-pumping, refrigeration and/or cooling, the use of the illustrative isothermal turbocompressor in a variety of types and scales of applications is expressly contemplated. In a typical application, however, the diameter of the spoke/fan portion is in an approximate range of 20 inches to 6 feet, while the external area of each spoke is approximately 0.1 to 4 square feet, and the number of spokes is approximately in the range of 6 to 24. Operating in a rotational speed range of approximately 400 to 2000 RPM, using a motor of approximately 0.5 to 2 HP, the unit should be able to accomplish heat transfer in a range of approximately 100 to 400 BTUs per minute. Of course, these parameters are only exemplary of a wide range of size and/or performance specifications for the turbocompressor of this invention.

While the use of the illustrative turbocompressor in a cooling application is shown and described above, it is expressly contemplated that the efficient isothermal properties of the compressor can be employed in a heating application—for example, in a heat pump embodiment. Accordingly, the "heat" shown exhausted from the turbocompressor 300 in FIG. 2 can be ducted or otherwise collected in a heating arrangement, and used to heat a desired object or space in accordance with conventional techniques.

II. TURBO-COMPRESSOR-CONDENSER-EXPANDER WITH OPEN FRAME DUAL-SPOKE FRAME STRUCTURE

The open framework structure shown in FIGS. 11-14 avoids design challenges resulting from implementing a stationary plenum and associated mechanical face seal arrangement requiring a large-diameter external seal. It also permits additional heat transfer (with possible condensation) and expansive decompression. An illustrative embodiment is shown which provides an isothermal turbo-compressor-condenser-expander (ITCCE) 1100 of FIG. 11. As shown, a precompression hub 1110 (the structure and operation of which is described further below) is at the center of the ITCCE 1100, in to which refrigerant flows to undergo a preliminary compression during the refrigerant cycle. The precompressed refrigerant then enters the ITCCE 1100 through a stationary inlet tube 1115 and down through a central passage in the axle 1117 to the first, inlet central hub 1110. As shown in greater detail in FIG. 14, precompression can be alternately implemented using, for example, a separate, discrete axial piston refrigerant compressor connected by conduits within the refrigerant loop. By way of example, this separate precompressor can be a type used in a conventional air conditioning/refrigeration system application. As described further below, the precompressor increases the refrigerant temperature, and allows it to flow into the turbocompressor stage at an appropriate temperature and pressure.

Referring back to FIG. 11, a plurality of spokes 1120 extend radially outwardly from the central hub 1110 in the form of a wheel-like spoke frame structure. As shown by arrow 1121, during rotation of the spokes, refrigerant is impelled through radial fins or blades 1130 to a maximum point of pressure and temperature at the ITCCE perimeter 1125. In an illustrative embodiment, by way of example, the overall framework has a diameter of approximately 3-4 feet at its perimeter and a height (axially) of approximately 6-16 inches. However, the size of the framework is highly variable and the dimensions provided above for the stationary plenum embodiment can also be applied to this embodiment. The fins or blades generate airflow over their surface to promote air exchange as they rotate during operation. As used herein, the term "spoke" can refer interchangeably to a complete structure defining an integral blade and internal passage, pipe or conduit, or can define an underlying framework structural member to which a conduit and/or blade are attached. As shown, the blades are mounted on, or surround, the spokes of the framework and associated conduits. The blades are in thermal contact with the conduits in each embodiment. The radial blades 1130 promote the air exchange as shown by the arrow 1135 indicating the force of drawing ambient outdoor air down through the ITCCE 1100. The refrigerant then flows down through axial blades 1140 as shown by arrow 1122. The blades 1140 further promote significant air exchange (and resulting isothermalism of the possible condensation of the refrigerant) by improving the amount of heated air that is expelled, as shown by arrow 1145. In an alternate embodiment, the orientation of the blades 1130 and 1140 may be modified or the direction of rotation of the device reversed to force the air to follow a path opposite to that described by arrows 1135 and 1145.

The elbows connecting the terminal ends of the axial blades 1130 to the entrance ends of the axial blades 1140 may possibly be interconnected by a solid rim to increase the physical rigidity to the device.

These blades are typically two to eight inches wide, and their width may be uniform from one side to another. A variable width of the fins is possible and expressly contemplated. It is desirable that the materials used for blades 1140 possess high thermal conductivity but may otherwise be highly variable. The blades can be single faced with a single piece of sheet metal or other material. They can be encased in a thermally conductive material, as shown in the illustrative embodiments.

The blades or fins according to illustrative embodiments can be sized and arranged to be no more than approximately half the diameter of the device, as well as constrained as to not be so large that the resultant structure is insufficiently open, so as to admit and expel the desired quantity of air for heat exchange. In an example, a ratio a maximum solid surface (blade surface, adjacent framework, etc.) to open voids can be approximately of 70%. The dimensions should generally allow sufficient extended surface to reject the heat from the refrigeration process. In an illustrative embodiment, there are provided twelve radial trapezoidal (basically triangular) perimeter-shaped blades measuring approximately 1 inch wide adjacent to the first central hub and approximately 6 inches wide at the outer perimeter, and having a radial length of approximately 15 inches. The axial blades are generally rectangular in perimeter shape, measuring approximately 8.5 inches (in the axial direction and 4 inches wide. As depicted, the radial and axial blades can be canted at an angle with respect to a tangent line of the framework's circular outer perimeter (for example 3-7 degrees) to enhance air movement through the framework, in the manner of an impeller fan. As to materials of construction, one would not want to be unduly limited, but thermal conductivity is an essential aspect to promote heat transfer between refrigerant flowing inside the blades and air impelled on the periphery of the blades.

The geometry and structure of the blades are highly variable to attain the desired heat transfer characteristics depending on the surrounding system, leading to the condensation if so desired. The blades can be hollow such that refrigerant fills the entire blade to undergo compression. The blades can be formed of a molded structure that is solid or semisolid having one or more conduit therethrough, for example as shown in FIG. 6 showing multiple conduits through a solid blade-shaped spoke. In each embodiment, the blade is in thermal communication with the conduit.

The surface of the blades is also highly variable, and can range from a flat smooth surface, to a textured surface for increased surface area and structural integrity. The surface can be textured or rippled according to the illustrative embodiments.

Figure 12:
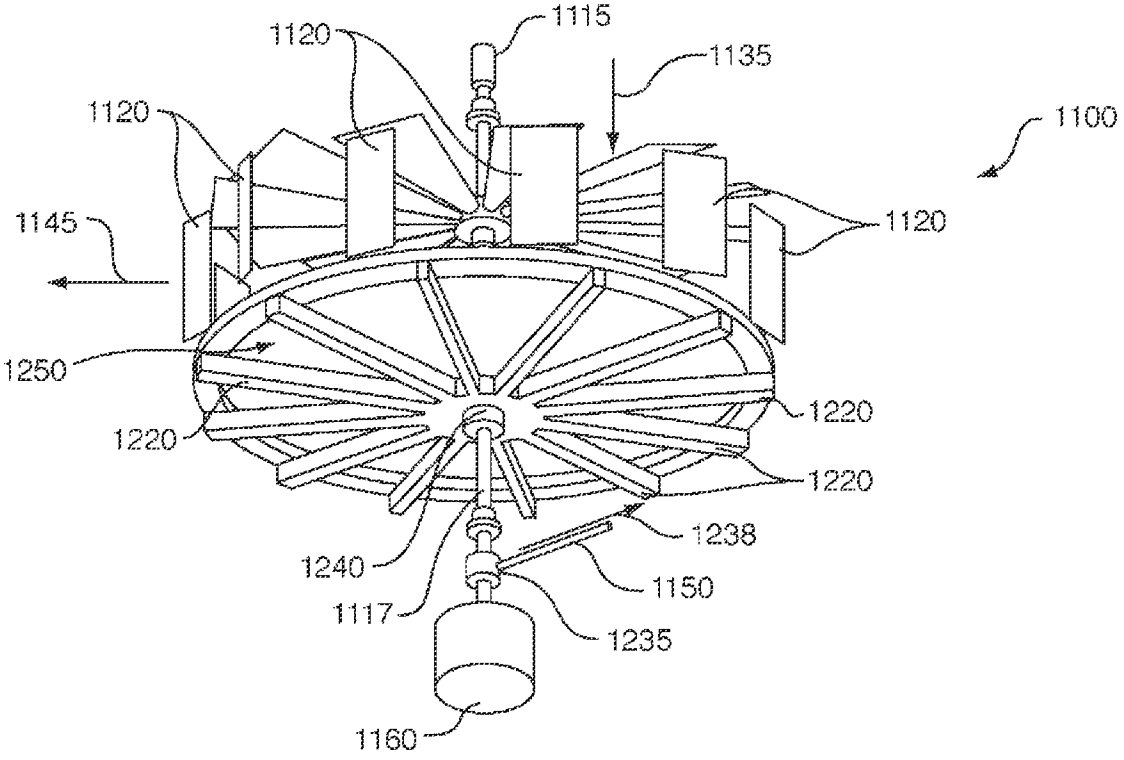
FIG. 12 is a bottom perspective view of the turbo-compressor-condenser-expander according to the illustrative embodiment.

After passing through the blades 1140, the refrigerant then travels through conduits in supported by the second set (the lower set as depicted) of spokes of the ITCCE 1100 (shown as spokes 1220 in bottom view of FIG. 12). The refrigerant then exits through a stationary outlet tube 1150. The motor drive 1160 rotates the central axle 1117 of the ITCCE 1100 at a desired rate, ranging between several hundred to two thousand revolutions per minute (RPMs), to rotate the spokes of the device such that the refrigerant undergoes centrifugal force for decompression during refrigeration or another heat exchange cycle. In this embodiment, the motor 1160 is shown, by way of example, located in an inline configuration driving the axle 1117. In alternate embodiments, such as described further below, the motor can be interconnected via a gear train, belt-and-sheave assembly, or other appropriate power transmission mechanism. The motor can be driven at a constant or a variable speed of rotation.

As shown in FIG. 12, the refrigerant flows through the conduits of the lower spokes 1220 to undergo decompression into a lower pressure, lower temperature fluid, as it flows into an outlet, central hub 1240. The refrigerant then flows coaxially with the central axle 1117 and into a stationary outlet collection space 1235.

The lower spokes 1220 may be straight or curved. It is desirable that the spokes 1220 be made of a thermally resistant material in order to minimize heat transfer with the surrounding air. Alternatively, they may be enveloped in a thermally insulating material, either singly or together. The spokes may otherwise be made from a variety of materials. The set of spokes 1220 and their insulation may be embedded inside a solid matrix (not shown in the illustration) so that the exterior surface of the lower wheel be smooth and offer low aerodynamic resistance while in rotation. Alternatively, the embedding matrix may serve as the thermally insulating material.

The ITCCE 1100 includes a covering disc 1250 on its bottom side, under which the lower spokes 1220 pass, to maintain stability of the ITCCE 1100 and improve structural strength (as well as to isolate the adjacent radial conduits from airflow generated by the axial and radial blades 1220, 1130). However, in further illustrative embodiments, the disc can be removed leaving only a spoke arrangement. The conduits of the second, lower spoke arrangement performs the expansion of the refrigerant as it flows back to the central axis of the ITCCE 1100. This decompression generates a physical torque that is similarly directed to the rotary movement of the device, thereby providing mechanical energy that contributes to the spin of the jointly rotating members of the ITCCE 1100 and decreasing the mechanical energy exerted by the motor drive 1160

Figure 13:
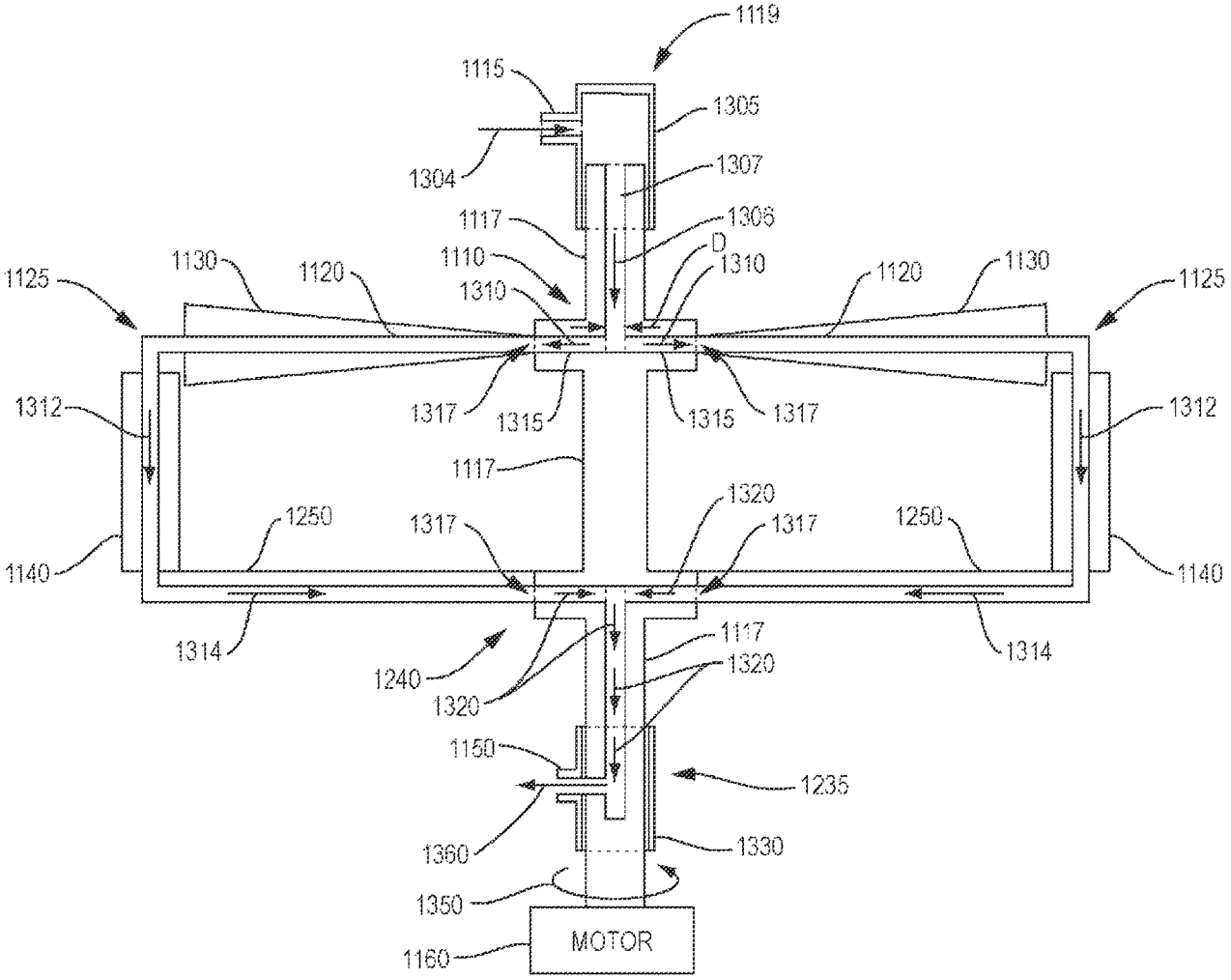
FIG. 13 is a cross-sectional schematic view of the turbo-compressor-condenser-expander according to the illustrative embodiment.

Reference is now made to FIG. 13 showing a cross-sectional schematic view of the flow of refrigerant within the ITCCE 1100. The refrigerant enters through an inlet tube 1115 as shown by arrow 1304. The stationary inlet tube 1115 feeds into an inlet collection tank 1119 that is rotationally fixed and joined by a rotary seal assembly 1305 to a coaxially rotating axle 1117, which provides an internal passage 1307 for refrigerant to pass through the axle 1117 into the hub 1110. The diameter 'D' of the internal passage can be and eighth of an inch to three-quarters of an inch in various illustrative embodiments. Other sizes, both smaller and larger, are contemplated for the passage and the spokes of the ITCCE 1100. This embodiment employs a single central axle 1117 that extends from the motor 1160 through the outlet rotary seal assembly 1330, through the lower hub 1240 and upper hub 1110 and terminates at the inlet rotary seal assembly 1305. The axle is hollow along at least two segments to provide for the inlet and outlet of refrigerant into the conduits 1120 of the ITCCE 1100. The bearing seal assemblies 1305 and 1330 can be of any acceptable construction described above with respect to the illustrative embodiment of FIG. 8 to allow the refrigerant to pass therethrough while the axle 1117 rotates. In one example the rotary seals can consist in device 008-12230-32, a high-speed air-hydraulic union (see by way of example:http: www.rotarysystems.com/series-008). Another exemplary rotary fluid union is available from Deublin of Waukegan, Ill., as model number 1102-070-029. This union comprises a ⅝"-18 UNF RH 21 1102-070-079 UNF LH combination. This device uses a spring loaded carbon graphite stationary face combined with a ball bearing supported polished steel rotating face, with a metal crush washer face seal. The size and scale of the unions used in this embodiment are proportional to output and scale of the ITCCE. Also, while not shown, at one or more points along the axle, there may be provided bearings for mounting the rotating assembly of the ITCCE within a stationary framework.

The refrigerant flows as shown by arrow 1306 down into the central hub 1110. The refrigerant then flows outwardly in the first, upper set of radial conduits of the spokes 1120 as shown by arrows 1310 out from the central hub 1110. The axle 1117 is hollow over a length that extends from its end inside the rotary seal 1305 to a place where its diameter increases at the hub 1110. The axle at its larger diameter of the hub 1110 is perforated with a plurality of radial passages 1315 that penetrate into the axle shaft 1117 so as to create conduits to and through the spokes 1120 of the ITCCE 1100 for the flow of refrigerant. The spokes are fastened to the shaft 1117 at these conduits by screws, fasteners, or other appropriate securing mechanisms 1317. The refrigerant flows radially out from the central hub 1110 in the first set of radial conduits of the spokes 1120. These conduits are surrounded by radial blades 1130 in thermal contact therewith. The refrigerant thereby achieves a maximum temperature and pressure at the ITCCE perimeter 1125.

The refrigerant then flows down through the axial blades 1140 as shown by arrows 1312 and heated air is passed out from the axial blades 1140 see arrow 1145 of FIG. 12). The refrigerant loses heat, possibly causing condensation. The refrigerant then flows, as shown by arrows 1314, back to the second, outlet central hub 1240 of the central axle 1117, and in the process undergoes expansion and its temperature drops. The thermally insulated tubes end at holes on the periphery of the shaft to which they are fastened by screws or by other securing mechanisms 1317. The refrigerant then flows down the central axis as shown by arrows 1320. The rotating seal assembly 1330 is rotatably fixed and joined to the stationary collection tank 1235. The axle 1117 rotates (arrow 1350) within the stationary collection tank 1235 via the rotating seal assembly 1330. The refrigerant flows out of the stationary collection tank 1235 via outlet tube 1150 as shown by arrow 1360.

Figure 14:
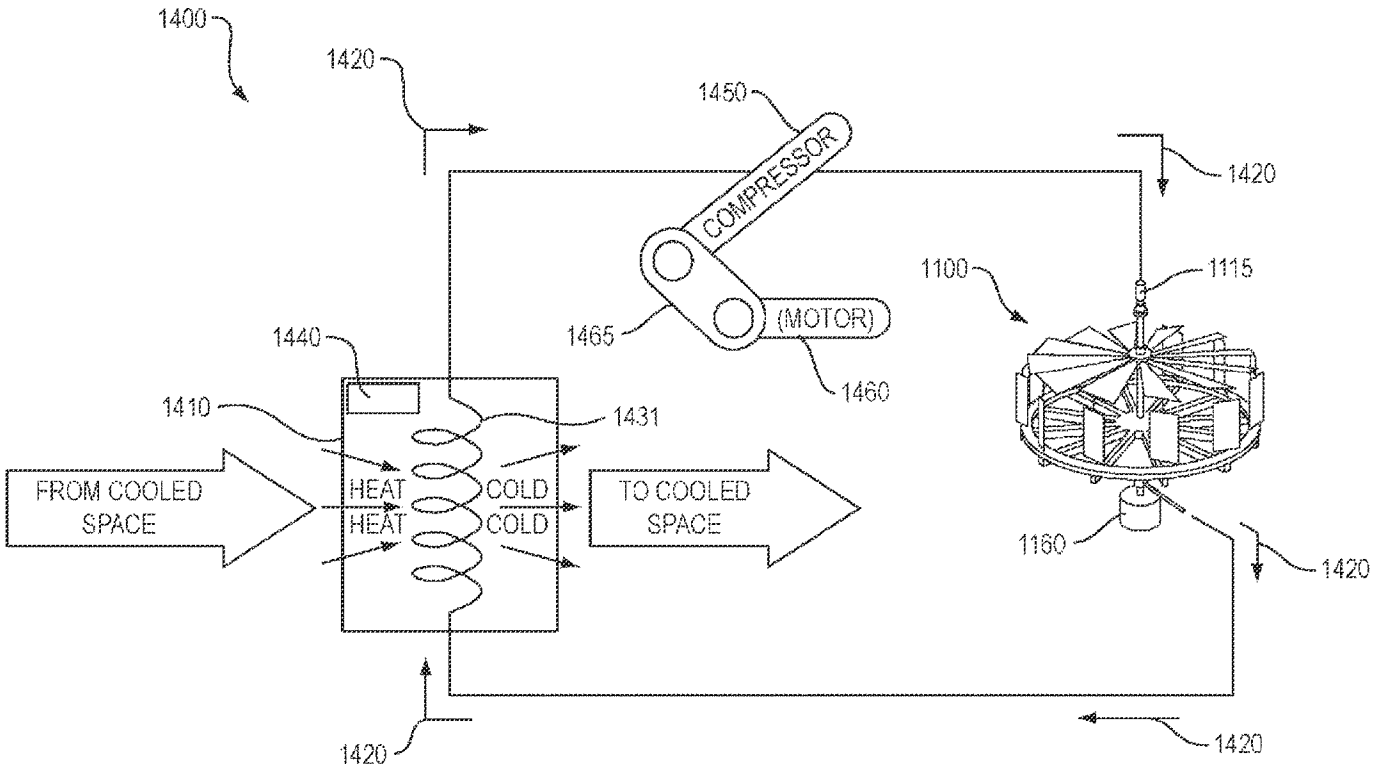
FIG. 14 is a block diagram of an air-conditioning/heat-exchange transfer system including a turbo-compressor-condenser-expander according to an illustrative embodiment.

In an operative embodiment, it is typically desirable to perform a separate, discrete precompression of the refrigerant prior to admitting it into the ITCCE at inlet tube 1115 in order that its temperature exceed the temperature of the surrounding air at perimeter point 1125. FIG. 14 shows a compression arrangement that includes both a discrete pre-compressor and an ITC according to an illustrative embodiment. The air-conditioning/heat-exchange system 1400 employs an ITCCE 1100.

FIG. 14 is a block diagram of an exemplary air-conditioning/cooling system loop 1400 comprising an ITCCE 1100 that performs the compression, cooling (with possible condensation) and expansion of refrigerant required to cool the airflow through compartment 1410. Refrigerant expansion/decompression occurs within the second radial set of conduits 1220. The expanded refrigerant enters directly from the outlet member 1150 to the compartment 1410 free of any separate expansion valve. In alternate embodiments, an optional expansion valve may be used if decompression along the return radial conduits is incomplete. A flow ambient air (or another fluid) is passed through the compartment 1410 possibly using a fan 1440 or equivalent impeller/mass-flow driver. As described above, the fan 1440 directs the air/fluid over coils 1431 within the loop or circuit 1400 to exchange heat from the air/fluid with the refrigerant as shown. Notably, the conventional compressor/condenser arrangement such as that illustrated in FIG. 1 (110), employing two devices in sequence to perform the two heat-transfer operations separately in a continual cycle (flow arrows 1420) through the loop 1400, has been substituted with a single ITCCE 1100 and a pre-compressor 1450 according to an illustrative embodiment.

In operation, the (higher-heat) refrigerant, in its gaseous form, enters the pre-compressor 1450 to undergo pre-compression. As shown, the pre-compressor is driven by a motor 1460 via a belt 1465, however the compressor can be driven according to any system or method for initiating the compression. The pre-compressed refrigerant then enters the ITCCE 1100 via a stationary inlet tube 1115, as described in greater detail above with reference to FIGS. 11-13. The ITCCE 1100, performs the compression via centrifugal force exerted on a set of spokes spinning under the drive of an electrically (or other form of motive power) driven motor 1160. Such compression occurs within the spokes after refrigerant is relatively evenly distributed thereinto via the hub 1110. The motor 1160 can be single speed, multi-speed, or variable speed as appropriate. Likewise, the size and power of the motor is highly variable. In an embodiment the pre-compressor raises the pressure of the refrigerant to approximately 5 atmospheres Notably, the ITCCE is constructed and arranged such that it also performs additional isothermal compression and performs the cooling, which may or may not include associated condensation, by drawing air or other cooling fluid across the device. The ITCCE further expands the refrigerant. In this manner, the fluid output 1420 of the ITCCE is a cooled, low-pressure refrigerant vapor possibly saturated with accompanying refrigerant liquid, similar to the output of a conventional expansion valve (125 of FIG. 1), but accomplished using the ITCCE 1100, as opposed to three discrete, interconnected devices for performing the compression, condensation and evaporation cycles of refrigerant in an air-conditioning system.

Figure 15:
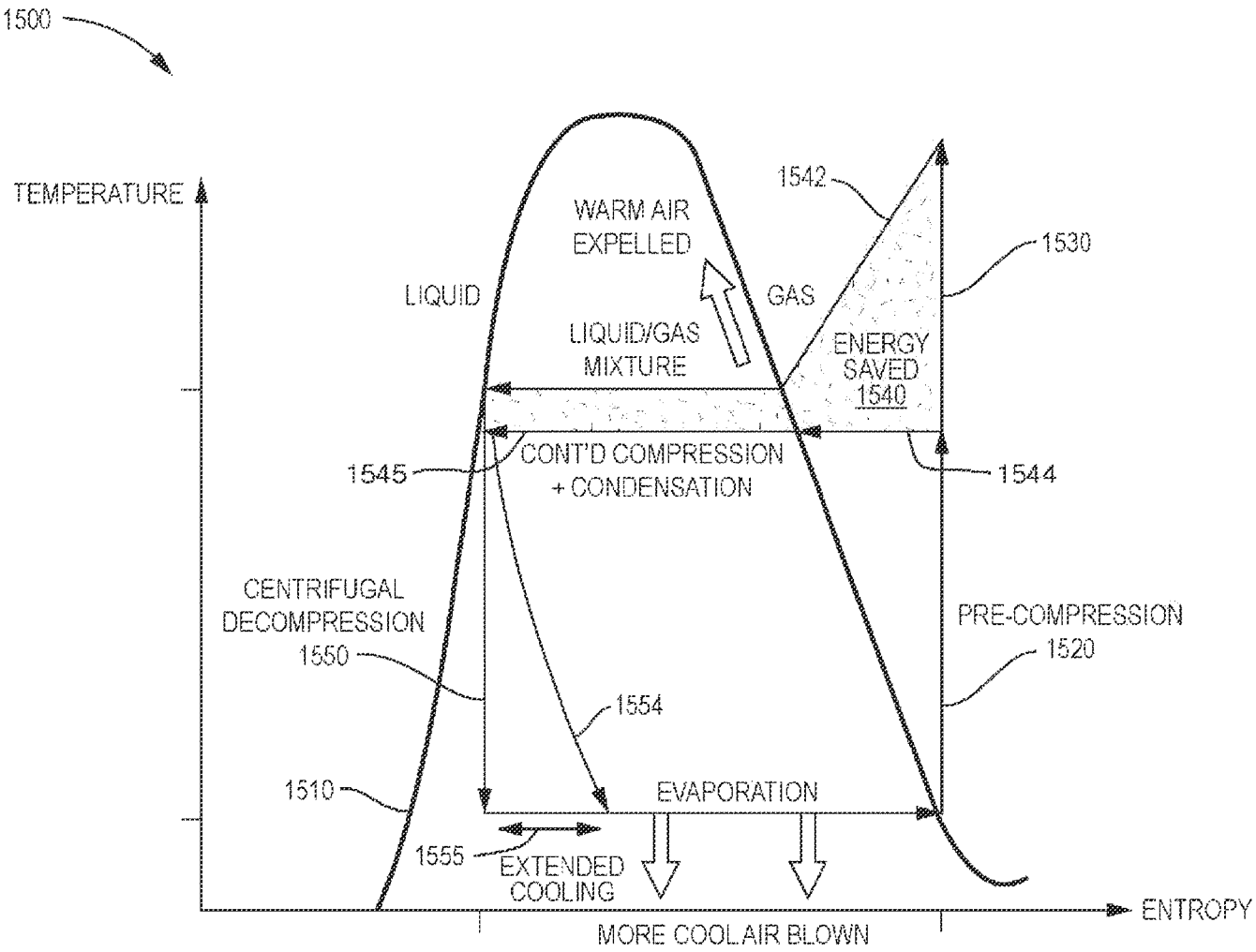
FIG. 15 is a graphical representation of the temperature versus entropy for a conventional refrigerant compression and decompression compared to the isothermal turbocompressor according to the illustrative embodiments

FIG. 15 is a generalized graph 1500 showing the energy saved by employing pre-compression according to the illustrative system of FIG. 14, as compared with a conventional refrigeration cycle. The graph is applicable to a variety of refrigerants, such as R-22, or more typically R-134a. The conventional refrigeration thermodynamic path (arrows 1530, 1542 and 1554) is a 1 ton air-conditioning unit. Line 1510 shows the state of the refrigerant as liquid, gas, or a liquid/gas mixture. One advantage of the ITCCE is that it can operate in the presence of liquid, a mixture of condensing vapor and liquid, or vapor alike, as it comprises the tubular channels with no reciprocating devices, one-way valves, or other similar mechanisms found in adiabatic compressors. According to a conventional compression refrigeration cycle, a compression of a supersaturated vapor is conducted because the presence of any liquid interferes with the mechanisms of a typical compressor device, and operation with a supersaturated vapor can prevent condensation. Because the ITCCE performs compression 1544, condensation 1545 and isentropic expansion 1550 gradually, and the gentle gradient in pressure from the axis to the perimeter follows more closely to the definition of a thermodynamically reversible process. Note that the first set of radial conduits (upper set as depicted) and associated blades perform compression as shown by the graph segment identified by arrow 1544. The axial conduits on the outer perimeter, and associated blades, perform condensation as referenced by the graph segment identified by arrow 1545.

Note that, while the term "condensation" and "compression" are used herein, it is contemplated that some refrigerants may become supercritical, rather than condensing in the typical sense, wherein the difference between vapor and liquid states in indistinct. The refrigeration cycle still occurs when using such refrigerants, but the temperature profile differs from that described in the graph of FIG. 15. Hence, in cases where such refrigerants that may move into a supercritical state for some or all of the refrigeration cycle (for example $CO_2$ and ethane), the terms "compression" and "condensation" should be taken broadly herein to include the behavior of such refrigerants. Note that a supercritical condition may occur within the axial conduits, and the condensation would occur in the second radial set of return conduits in the form of phase separation.

Arrow 1520 of the graph 1500 shows the pre-compression performed according to an illustrative embodiment. The arrow 1530 shows the further compression required of a conventional refrigeration cycle. Thus the shaded area 1540 represents the energy saved by the system employing a pre-compressor 1450 and ITCCE 1100, as shown in the illustrative embodiment of FIG. 14. The graph of FIG. 15 further shows the additional energy required to convert the gas back to a liquid of arrow 1542, not required for ITCCE 1100 because it can be a gas or a liquid. The ITCCE undergoes reversible (constant entropy) centrifugal decompression as shown by arrow 1550. The mechanical energy produced by this decompression (expansion) is communicated to the rotary device, thus reducing the energy demanded for the compression performed by the ITCCE. Furthermore, at its exit from the ITCCE, the refrigerant is in a state of lower entropy compared to its state at the exit of the expansion valve in a conventional system. The ITCCE thus extends the cooling time (thereby improving the amount of cooled air that is transferred) as shown by the extended cooling arrow 1555 of FIG. 15.

Figure 16:
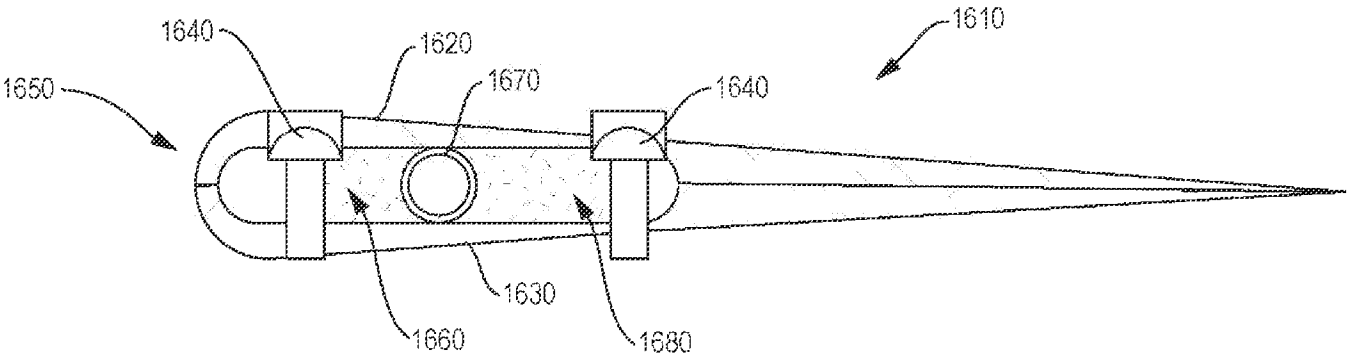
FIG. 16 is a side cross section of an airfoil shape applicable to a heat-transfer blade of the turbo-compressor-condenser-expander in accordance with embodiments herein.

FIG. 16 depicts an illustrative axial cross-sectional shape for a heat-exchanging blade 1610 according to an embodiment. As noted above, the shape and structure of the fins, blades or other aerodynamic heat-exchanging elements are highly variable. In the above-described embodiment, a diamond airfoil constructed from sheet steel or aluminum alloy is employed for ease of construction. However, other shapes are expressly contemplated, such as that depicted in FIG. 16. This blade 1610 generally defines a NACA airfoil having a symmetrical teardrop shape. In this embodiment, a pair of airfoil halves 1620, 1630 is formed, in whole or in part, from cast or stamped metal, carbon composite, or another heat-conducting material. The halves are joined together using plurality of fasteners (screws, rivets, etc.) 1640, at appropriate locations along the blade surface. The blade defines, adjacent its leading edge 1650 a passage 1660 that can be filled with fluid, or house one or more fluid conduits (a single conduit 1670 in this example). The conduit is in contact with the blade material to facilitate heat-transfer. Additional structures can be used to increase surface contact between the conduit 1670 and blade material. Likewise, a thermally conductive packing 1680 can surround the conduit within the passage 1660. In alternate embodiments, the blade 1610 can also be implemented as an asymmetrical airfoil. Note that the term "airfoil" as used herein should be taken broadly to include any shape that causes a redirection of airflow thereover, including, but not limited to single sheet blades and vanes and diamond-cross section blades. Note that, where blades are not used in the framework for heat transfer, they can be constructed from a low-heat conducting material, such as laminated wood or fiberglass composite. The conduit 1670 inside blade 1610 may follow a straight path, a sinuous path, or any other path in order to promote heat transfer between the refrigerant it contains and the embedding material.

Figure 17:
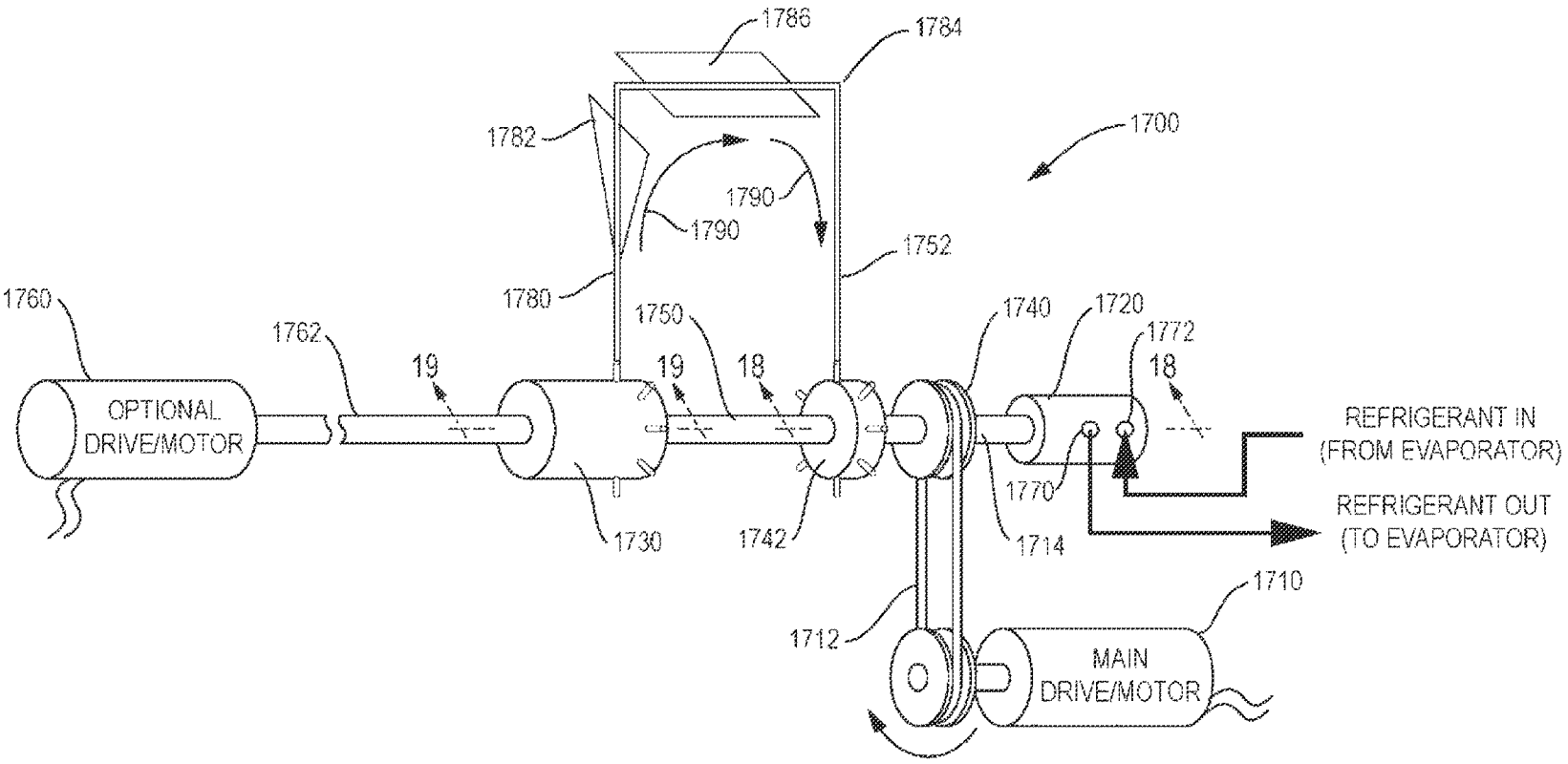
FIG. 17 is a diagram of an arrangement including a turbo-compressor-condenser-expander according to an alternate embodiment, including a coaxial precompressor and a coaxial fluid union providing both a refrigerant inlet and refrigerant outlet.
Figure 19:
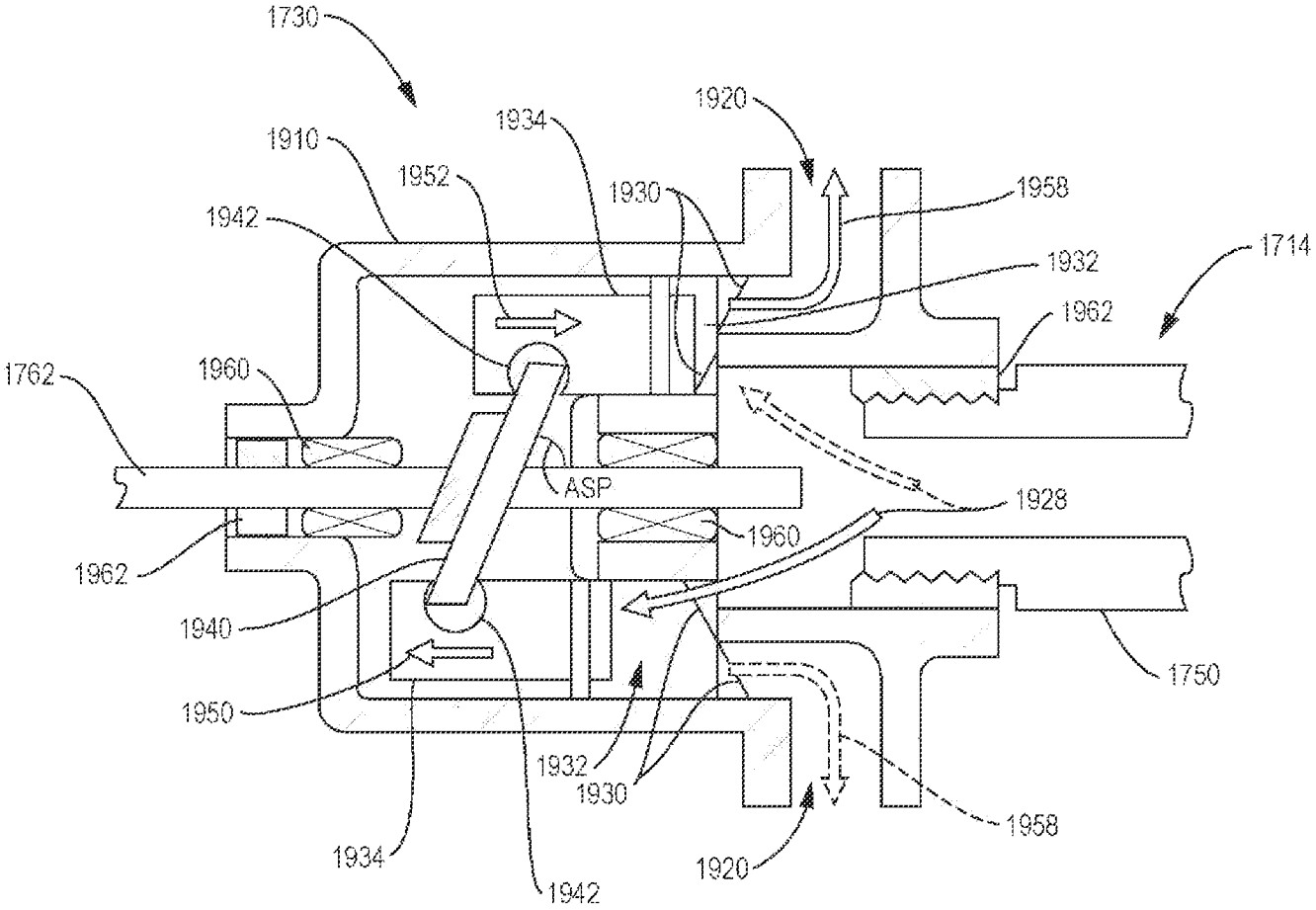
FIG. 19 is a side cross section of the coaxial precompressor taken along line 19-19 of FIG. 17.

Reference is now made to FIG. 17, which details an alternate embodiment of the isothermal turbocompressor-condenser-expander 1700. As shown, the main drive motor 1710 is mounted in an offset arrangement, and operatively connected to the main shaft assembly 1714 by a belt and pulley assembly. A gear train or other power transmission arrangement can be employed in alternate embodiments. The main shaft assembly 1714 is generally hollow along its length between a coaxial fluid union 1720 and a coaxial precompressor 1730, each described in further detail below. The main shaft assembly 1714 extends past the motor drive sheave 1740 to fluid-transferring the central hub 1742. Axially for the hub, the main shaft assembly 1714 defines a hollow connecting shaft 1750 that extends to the coaxial precompressor assembly 1730 of this embodiment. As described below, the precompressor assembly is driven by a secondary shaft 1762, which is independent of rotation of the main shaft assembly 1714. In an embodiment, the shaft 1762 is stationary (i.e. non-rotating and fixed to the associated mounting assembly). In alternate embodiments, the shaft 1762 can be supplementally, or alternatively, driven by an optional drive motor 1760. The optional drive motor can comprise a "canned" rotor that is enclosed within the housing (1910) fluid circuit and separated hermetically from the stator by a membrane. Likewise, the motor and shaft (1762) can be linked to the housing by a magnetic coupling that avoids the need for the seal 1962. The stationary embodiment of the shaft 1962 can likewise be interconnected with the piston assembly via a magnetic coupling that eliminates the through-shaft and seal arrangement depicted in FIG. 19.

Figure 18:
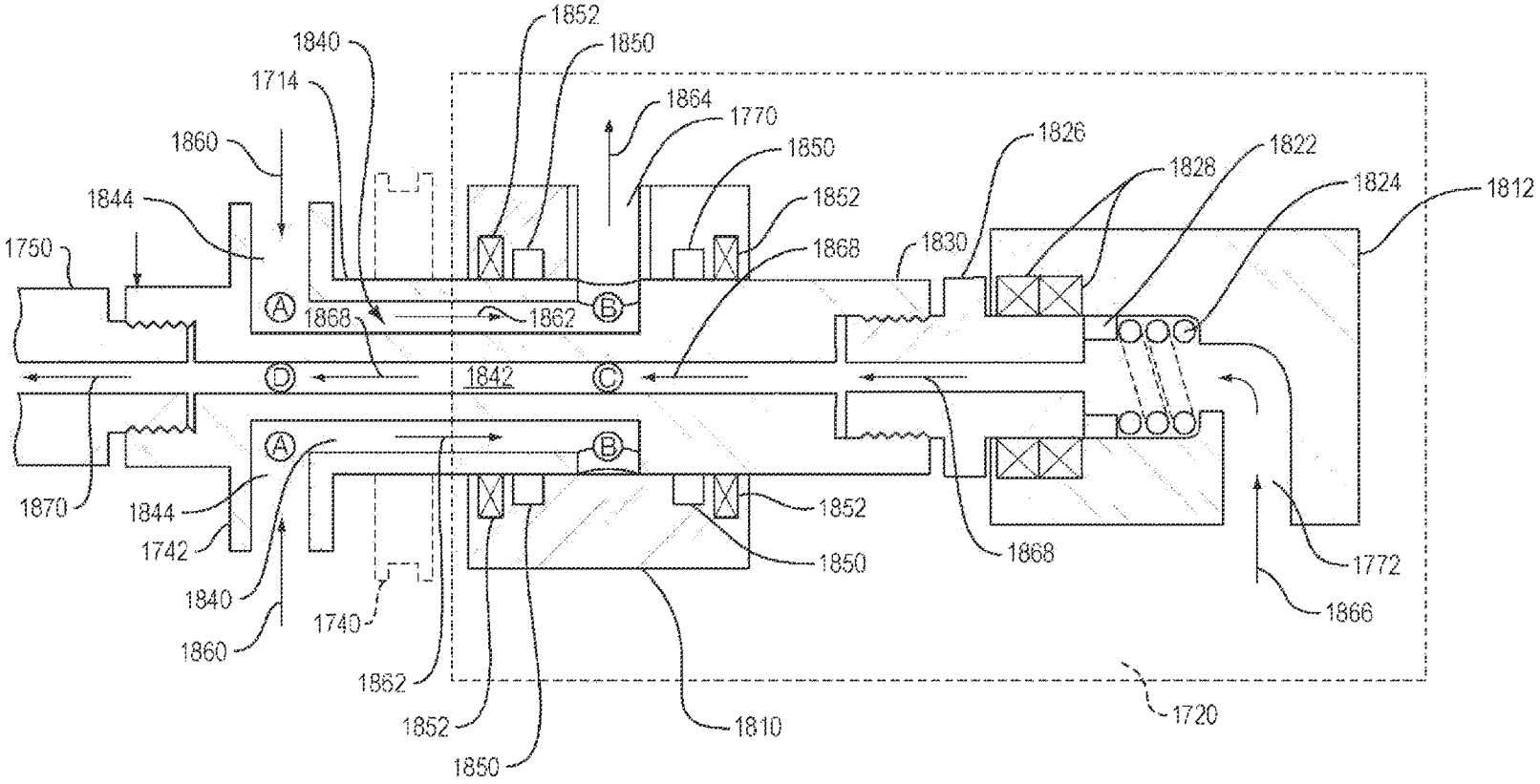
FIG. 18 is a side cross section of the coaxial fluid union and adjacent main shaft assembly components taken along line 18-18 of FIG. 17.

With further reference to the side cross section of FIG. 18, the coaxial fluid union 1720 and adjacent main shaft assembly 1714 is shown in further detail. This coupling provides both an outlet 1770 for cold, low-pressure refrigerant to be delivered to the evaporator assembly (in the refrigerant loop), and an inlet 1772 for evaporated, low pressure refrigerant delivered from the evaporator assembly back to the ITCCE. Both the inlet 1772 and outlet 1770 are provided on stationary (non-rotating) bases of rotatable fluid couplings 1812 and 1810. The inlet coupling 1812 includes a face seal 1822 that is biased by a spring 1824 into engagement with a rotating base 1826. The rotating base 1826 is rotatably interconnected to the inlet base 1812 by a set of bearings 1828 that allow free rotation therebetween while the face seal 1822 avoids loss of fluid through the rotating joint. The rotating joint forms a hollow passage for refrigerant from the stationary inlet base 1812 into the rotating shaft member 1830. The rotating shaft member 1830 extends axially to the stationary outlet base 1810 that is in fluid communication with an external channel system 1840 formed coaxially with a central channel 1842. The channel system includes a series of passages disposed about the circumference of the shaft and each interconnected with a port 1844 in the return (lower or "second") central hub 1742. The outlet base 1810 is sealed with respect to the shaft 1830 by stationary face seals 1850.

Rotation between the base 1810 and shaft 1830 is facilitated by bearings 1852. Thus, expanded refrigerant returns (arrows 1860) from the radial conduits 1752 to the hub 1742, and then travels (arrows 1862) along the passages 1840 into the stationary outlet base, where it is directed (arrow 1864) to the evaporator via the loop.

The evaporated refrigerant enters from the loop (arrow 1866) via the inlet base 1812 and passes (arrows 1868) into the central channel 1842. The refrigerant thereafter travels axially past the hub 1714 and into (arrow 1870) the hollow connecting shaft 1750 that interconnects the two spoke hubs. The refrigerant then travels axially into the precompressor (upper or "first") hub assembly 1730 according to this embodiment. The precompressor hub, like the return hub 1742 acts as an interconnection for each conduit and blade loop (for example, radial conduit 1780 and radial blade 1782; axial conduit 1784 and axial blade 1786; and radial conduit 1752). These hubs 1742, 1730 also support the framework structure for each spoke under the rotational torque of the main drive motor 1710.

The precompressor 1730 can be constructed in a variety of manners. In this example, and referring also to FIG. 19, the precompressor includes an outer housing 1910 that supports the spoke framework (not shown), and defines ports 1920 associated with each radial compression conduit and blade assembly (1780, 1782). The housing 1910 rotates on the end of the hollow connecting shaft 1752, that is driven by the motor 1710 and associated linkages and couplings. Refrigerant travels from the connecting shaft 1750 into the interior of the housing 1910. The fluid then selectively travels (arrows 1928) trough an array of suction and discharge reed valves into cylinders 1932 positioned around the circumference of the housing. The number of cylinders 1932 can equal the number of ports 1920 or a cylinder can interconnect via appropriate fluid channels in the housing 1910 with multiple ports. The cylinders 1932 each house a respective piston 1934 that reciprocate within the respective cylinders based upon the interaction of a stationary (or separately driven) swash plate 1940 and a cylinder groove 1942. The swash plate 1940 is fixed to the shaft 1762 at a relative angle AS, as shown. The shaft moves differentially with respect to the housing 1910—either due to a separate drive connection (e.g. motor 1760), or due to the rotational differential between a fixed shaft 1762 and the rotating housing 1910. The swash plate 1940 thereby rotates with respect to the pistons and its relative mounting angle ASP conforms to the stroke distance for each piston. The swash plate thereby urges the pistons back and forth as its edge rides in each piston's groove 1942.

The reed valves 1930 open and close in response to the stroke of the respective piston 1934 so that refrigerant is drawn (arrows 1928) in from the shaft 1750 when pistons move in a downstroke (arrow 1950) and expelled (arrows 1958) under compression into the ports 1920 when the pistons move in an upstroke (arrow 1952). Appropriate bearings 1960 and face seals 1962 prevent fluid loss through the housing at the interface with the connecting shaft 1750 and the drive shaft 1762. In this manner the flow (arrows 1780) of precompressed refrigerant into further compression in the first radial conduits 1780, condensation in the axial conduits 1784 and predetermined expansion in the second set of radial (return) conduits is maintained.

It should be clear that the operative principles used to construct the precompressor are highly variable, and this embodiment can also be implemented with a central hub that is free of a precompressor, and a discrete, separate precompressor within the loop.

Note also, with reference to FIG. 18 that the region of counter-current refrigerant flow designated as ABCD is advantageously arranged to transfer heat in when certain types of refrigerant would benefit from such heat-transfer. When using alternate refrigerants, a more adiabatic arrangement, with less or no heat transfer is desirable. In such instances, an insulating layer can be provided between the inner passage 1842 and outer passages 1840.

By locating the drive sheave, inlet base and outlet base on one end of the device, it is contemplated in an alternate embodiment that the framework can be constructed in a cantilever manner. That is, the structural support is primarily provided on one side of the device, and the shaft is supported adjacent to the inlets and sheave.

As in other embodiments described herein, the size of conduits, passages and other refrigerant-handling components is highly variable. Sizing is generally associated with desired BTU output and overall refrigerant charge of the unit. Sizing of components can be optimized using conventional fluid-dynamic and thermodynamic principles, as well as through experimentation, employing trial and error to determine optimum component size.

III. IMPROVED SPOKE ARRANGEMENT AND FLUID FLOW

A. Equalizing Lines

Figure 11:
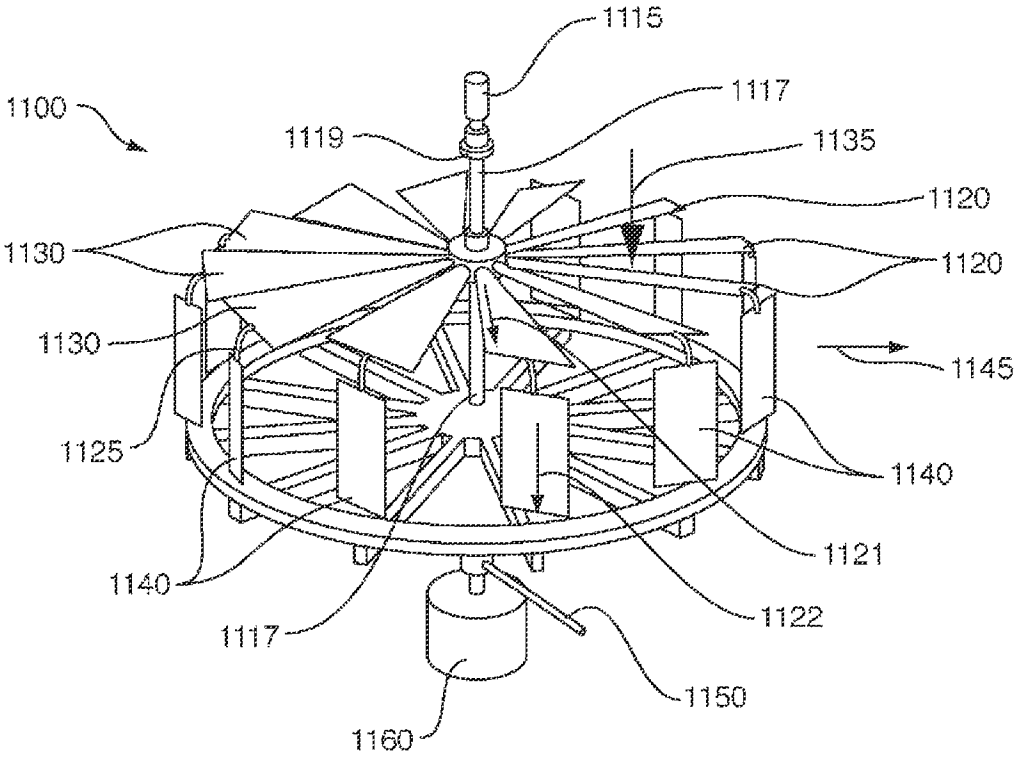
FIG. 11 is a top perspective view of a turbo-compressor-condenser-expander comprising an open framework and a fluid circuit that extends from and returns to a hub according to an illustrative embodiment.

The embodiment of FIGS. 11 and 12, which directs fluid flow through the parallel branches originating in the first central hub and returning to the second central hub, could exhibit instability under certain conditions. More particularly, should the rate of condensation, related heat transfer, and/or frictional effects in the conduits vary sufficiently, then the condensed refrigerant in one or more of the returning lines can tend to be displaced by a flow of uncondensed gas. Mechanistically, as long as the frictional losses from vapor flowing through the conduit are substantially different than those of condensed liquid, as is often the case, this leads to a situation where uncondensed gas bypasses the fluid branches, until the frictional effects from its greater flow equalize with that of the reduced parallel flows of condensed refrigerant in the overall parallel flow network, substantially reducing the amount of condensed refrigerant supplied to the second central, or outlet, hub, which is highly undesirable.

Figure 20:
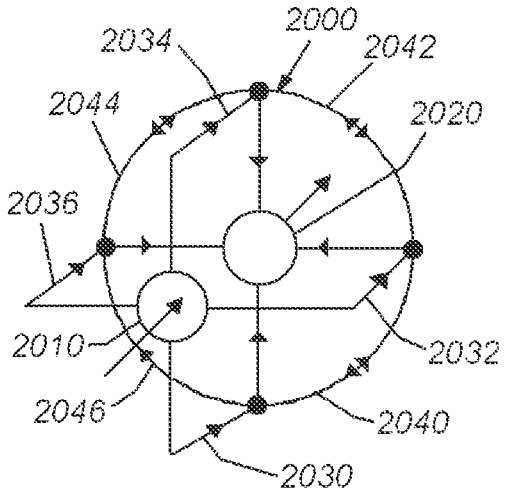
FIG. 20 is an isometric schematic diagram of fluid flow using an intermediate arrangement of equalizing lines to balance flow through conduits of the turbocompressor with respect to differences related to friction, condensation and related effects, according to embodiment.
Figure 21:
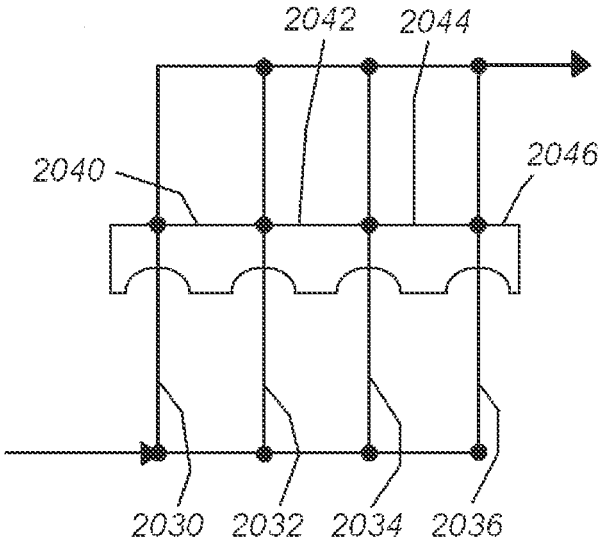
FIG. 21 is a schematic diagram of the arrangement of FIG. 20 shown as a circuit.

In an embodiment, this undesirable condition can be addressed by providing an arrangement of additional, intermediate conduits, termed herein "equalizing lines", which connect the parallel branches to their nearest neighbors at the perimeter, furthest from the central hubs. Connection of equalizing lines around the entire perimeter of the turbocompressor thereby creates an intermediate plenum in which small imbalances in flow and pressure between the channels are equalized by transfers of modest amounts of condensed refrigerant from one parallel branch to another. As shown schematically in an embodiment of the turbocompressor 2000 in FIG. 20 (in three-dimensions) and FIG. 21 (as two-dimensional representation), fluid in the turbocompressor is arranged to move between the two opposing central hubs 2010, 2020 along at least four (4) parallel paths 2030, 2032, 2034 and 2036 in the expected direction(s) of flow (arrows) during operation. These paths are interconnected (represented by enlarged connection dots) by a perimeter arrangement of equalizing lines 2040, 2042, 2044 and 2046. As shown, fluid is enabled to flow freely between the paths 2030-2036 bidirectionally (double arrows), thereby allowing flow along each path to be equalized. Thus, the possibility of one path/branch discharging a high flow rate of uncondensed refrigerant into the hub 2020 is greatly reduced and the turbocompressor operates at an optimal efficiency, as intended.

B. Multiport Conduit (Blade) Extrusions

Figure 22:
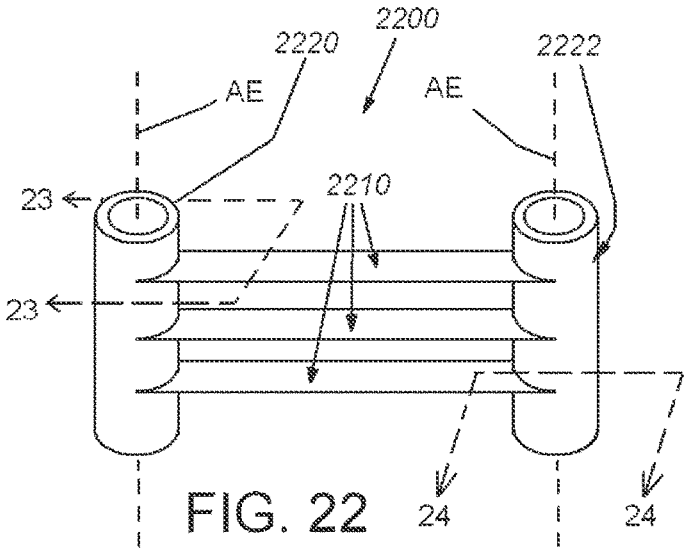
FIG. 22 is a diagram of a section of a heat exchanger that can be employed in the turbocompressor of various embodiments herein.
Figure 23:
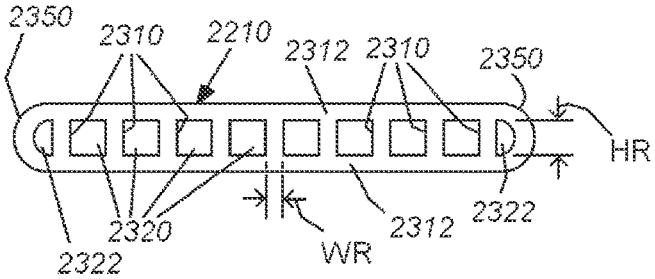
FIG. 23 is a cross section of an illustrative conduit extrusion for the heat exchanger, taken along line 23-23 of FIG. 22, showing a series of parallel internal ports separated by unitary ribs.
Figure 24:
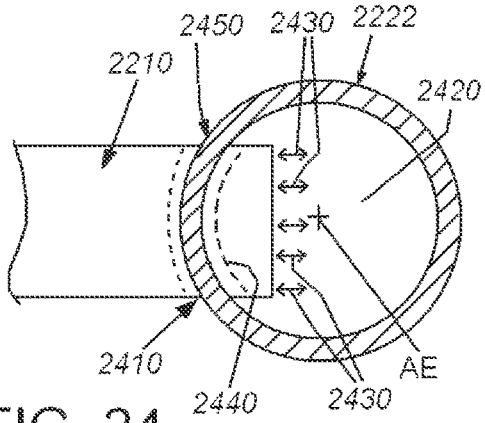
FIG. 24 is a cross section of a tubular channel of the heat exchanger showing a joint between a conduit extrusion and the channel, taken along line 24-24 of FIG. 22.

A common technique for constructing inexpensive mass produced fluid to air heat exchangers for automotive use, and increasingly in heating, ventilating, and air conditioning practice, is that of the brazed aluminum (or other similar metal) heat exchanger. It is generally advantageous (cost-effective) to use extruded aluminum tubes and channels of invariant cross section when constructing a heat exchanger in a mass production scenario. A principal constraint upon leak-free heat exchangers is that joint spacing and tolerance should be well-controlled to allow for proper flux and braze action on the individual pieces during assembly. FIGS. 22-24, thus, describe an adaptation of the established construction techniques and structures for brazed aluminum heat exchangers to an isothermal turbocompressor-condenser-expander device according to the embodiments herein. Shown below in FIG. 22 is a typical heat exchanger assembly 2200 in accordance with a generalized embodiment depicting the intersection of a plurality of flat, multiport conduit (also sometimes termed herein as "multiport fin" or "multiport blade") extrusions 2210 (described further below) that each contain internal ribs (described below), with a pair of opposing tubular channels 2220 and 2222, each having associated slits for receiving a respective end of the extrusion 2210. Note that the tubular channels 2220 and 2222 can be the inner and outer perimeter tubes of a turbocompressor-expander bladed assembly as described further below.

With further reference to FIG. 23, the extrusion 2210 is formed with a plurality of internal ribs 2310 between outer walls 2312 that divide the interior of the otherwise hollow shape into a series of contiguous ports 2320 that run in parallel, the full length of the conduit extrusion. The width WR of each individual rib is variable depending upon the type of material employed, the limitations of the extrusion process, and the overall size/shape of the extrusion cross section. The width WR is sufficient to provide desired structural integrity and prevent crushing of the structure under normal loading forces. The width is also dependent upon the associated height HR of each rib 2310. Note that the cross section shape of the extrusion 2210 is symmetrical in this embodiment, but can define another shape (e.g. a symmetric or asymmetric airfoil) in alternate embodiments. The size/shape of the internal ports 2310 is generally similar across the width of the extrusion 2210 in this embodiment (with exception of the end ports 2322, which are each shaped to conform to the rounded ends of the extrusion). In other embodiments, the internal ports can vary in size/shape as the outer walls of the extrusion vary in cross section. Likewise, the outer wall thickness can vary across the width of the cross section to address any manufacturing or loading issues. Illustratively, the spacing between ribs can also vary, in part to equalize the area of each internal port as outer wall spacing varies. That is, the ribs can be spaced further apart for a closer outer wall spacing and the ribs can be spaced closer together for outer walls spaced further apart (thereby roughly equalizing cross sectional area and flow volume for each internal port). Notably, the ribbed cross section enables extrusion of blades of any length with an internal structure that maximizes fluid flow therethrough and increases surface contact between the fluid passing through the extrusion between and the heat-conducting metal of the blade extrusion. Illustratively, the blade extrusion can be formed with an overall twist to increase airflow over the blade extrusion surface.

As shown in FIG. 24, the joint 2410 between a blade extrusion 2210 and tubular channel 2222 allows for fluid communication (double arrows 2430) between the inner volume 2420 of the channel 2222 and the internal ports of the blade extrusion 2210. The joint 2410 can be formed by brazing, welding, high-strength adhesives, or any other technique known to those of skill. The joint is formed in a straightforward manner by use of an end mill or slitting saw that plunges into the side wall 2450 of the tubular channel 2222. The opposing ends 2350 (FIG. 23) are shaped (e.g. radiused) to conform to the shape of the cut ends. After assembly of the extrusion 2210 and the channel 2222 (with the extrusion extending through the channel wall) the joint 2410 can be completed by oven brazing, which greatly reduces the possibility of capillary action drawing the brazing metal into, and blocking, the small-cross-section internal ports in the extrusion, which is undesirable. Note that the end shape of the blade extrusion can be cut to more closely conform to the inner wall geometry of the tubular channel 2222—as depicted by the semi-circular dashed line 2440.

Note that the depicted joint 2410 is oriented vertically/perpendicular with respect to the axis of elongation AE of the channel 2222. As described below, it is contemplated that the slot can also be oriented horizontal/parallel with respect to the axis of elongation AE or at a non-parallel and/or non-perpendicular orientation (acute angle) with respect thereto. The vertical orientation is desirable where length along the plenum is limited—generally due to close spacing of blades in this area. Likewise, while each tubular channel/plenum defines a circular cross section in the depicted embodiment, it expressly contemplated that the cross section can be another curvilinear and/or polygonal shape—e.g. triangular, rectangular, square, ovular, combinations thereof, etc.

C. Toroidal Multiport Conduit Plenum

To effectively utilize the above-described constant cross section (along the elongated/extrusion direction) aluminum (or other metal) multiport extrusion in a turbocompressor-condenser-expander device, the geometry of the slit tube channel (e.g. channels 2220, 2222) intersecting with the multiport conduit extrusion (e.g. blades 2210) can be modified by forming each of the inner and outer channel tubes (2220, 2220) into a circular configuration, thereby defining a pair of toroidal plenums of differing diameter that the multiport extrusions connect between as a series of wheel spokes. These toroidal plenums can be formed from a straight extruded, seamless tube (e.g. aluminum) that is bent into a rounded form and welded, brazed or otherwise joined into a fluid-tight configuration at a seam.

Figure 25:
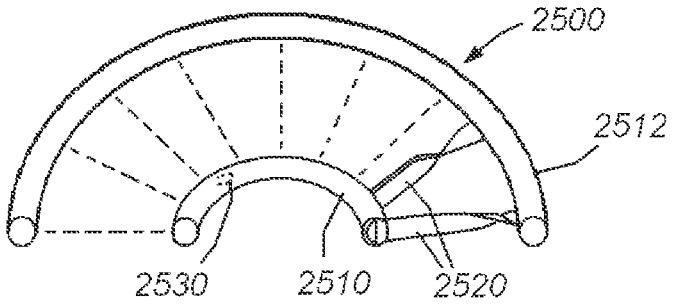
FIG. 25 is a cutaway perspective view of a turbocompressor assembly having inner and outer toroidal plenums joined by radially interconnected multiport conduit extrusions.

FIG. 25, thus, shows a semicircular section of an overall circular/toroidal plenum assembly 2500 for use in an isothermal turbo-compressor-condenser-expander device according to an embodiment. In this depicted embodiment, the inner channel/plenum 2510 and outer channel/plenum 2512 are arranged concentrically. A hub (not shown) can be located at or within the inner plenum 2510 to drive the overall assembly 2500.

It is contemplated that the multiport conduit extrusion 2520 interconnecting the plenums 2510, 2512 (or in other embodiments) can be readily formed into a desired finished shape for inclusion in the overall assembly 2500 by bending, pressing and/or twisting without compromising the blade's pressure containment ability. As shown, the multiport conduit extrusions are twisted axially (in the general shape of a helix) along a respective longitudinal/elongated conduit axis) so that the blade ends joining to the inner plenum 2510 are oriented vertically to fit into a limited distance—due to the inner plenum's position at the central hub. The outer ends of the blades, joined to the outer plenum 2512, are oriented horizontally, as distance along this plenum is greater than that of the inner plenum, thereby allowing for ample room to join such blades. In this embodiment, the blades 2520 exhibit a 90-degree axial twist placing their opposing ends at perpendicular orientation with respect to each other.

Note that the inner plenum 2510 is provided with at least one (and potentially a plurality of) connection(s) 2530 (shown in phantom in FIG. 25) of appropriate size and shape to interconnect to the fluid coupling in the drive hub (see, for example, channel 1770 and flow arrow 1864 in FIG. 18 above).

Figure 26:
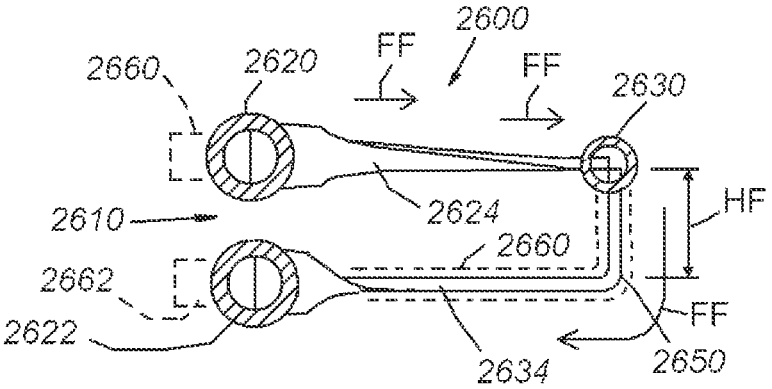
FIG. 26 is a side cross section of a turbocompressor-condenser-expander assembly having hub-mounted inlet and outlet plenums, an outer equalizing plenum, compressor multiport conduit extrusions and condenser multiport conduit extrusions.

As shown in FIG. 26, this arrangement can be extended in the assembly 2600 to provide both a toroidal inlet plenum 2620 and a toroidal outlet plenum 2622 in the region 2610 of the central hub. In this embodiment, the inlet plenum 2620 is interconnected via vertically oriented joints with a coplanar set of multiport conduit extrusions 2624 that are each axially twisted 90 degrees along its radial length to join an outer plenum 2630. The toroidal outer plenum 2630 functions as an equalizing line assembly, as described above. Notably, a second, longer set of multiport conduit extrusions are joined at a right angle along a bottom side of the outer plenum 2630 via horizontal slots. These conduit extrusions are show extending downwardly by a distance HF and the radially inward via a right-angle bend 2650. Notably, these fins 2634 (or the upper fins 2624 where the fluid flow (arrows FF) is reversed) can include insulation 2660 and define return path for condensed refrigerant fluid. The rate of turn of the axial bend for each set of multiport conduit extrusions 2624 and 2634 can be customized over their respective length to define the desired combination of axial and radial air flow for effective cooling of the surface of the fin based conduits (e.g. fins 2624), or to minimize the additional air flow and drag on the insulated return conduit surfaces (e.g. blades 2634). Thus, as shown, the twist of the upper blades 2624 is distributed along the entire radial length of the structure to generate maximized flow, while the lower, return conduits 2634 define an abrupt 90 degree bend adjacent to the outlet plenum 2622 so that the majority of each conduit's (2634) radial length is relatively flat, reducing drag. Additionally, in an embodiment, the cross-sectional diameter of the inner wall of the outer toroidal plenum 2630 can be beneficially reduced to reduce the overall fluid volume and mass of this higher pressure, centripetally accelerated section of the bladed assembly 2600. As noted above, the desired flow equalization characteristic is inherently present in the outer toroidal plenum.

Note again that the inner plenums 2620 and 2622 are provided with respective fluid connections 2660 and 2662 (shown in phantom in FIG. 26) along one or more locations on an inside surface that allow interconnections with drive hub fluid couplings—for example channels 1770 and 1772 in FIG. 18, respectively.

During manufacture, after oven brazing of the conduits to the plenums 2620, 2622 and 2630, the inner toroidal plenums 2620 and 2622 can be opened up with a machining operation to allow a suitable interface to the hollow drive shaft and fluid distribution to be welded, or more typically, friction-stir-welded to it. In another embodiment, it is contemplated that a plurality of conventional tubular conduits can extend radially from the central hub and connect to the inner toroidal plenum(s).

The length scale of the individual channels of multiport extrusion are particularly suited to reducing the tendency of refrigerant fluid to spin in such a way that would represent undesirable additional friction and energy loss in the expander portion of the turbocompressor-condenser-expander device. It should be noted that the use of multiport extrusion in the turbocompressor-condenser portion (conduits 2624) of the device does not preclude the use of conventional tubing in the expander portion (i.e. in place of return conduits 2334). It is also contemplated in embodiments that the number of radial branches in the turbocompressor-condenser portion of the device need not match the number of branches in the expander portion, which furthermore can be substantially fewer than the compressor-condenser portion.

Figure 27:
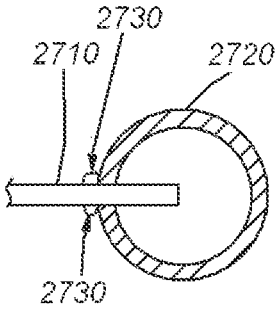
FIG. 27 is a side cross section of the joint between a tubular plenum and a multiport conduit extrusion along a horizontal/lengthwise slot in the plenum.
Figure 28:
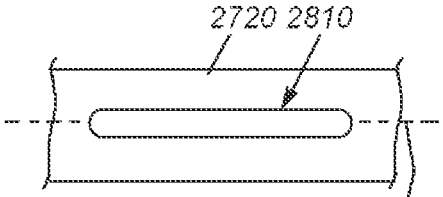
FIG. 28 is a side view of a horizontal/lengthwise slot in the tubular plenum of FIG. 27.
Figure 29:
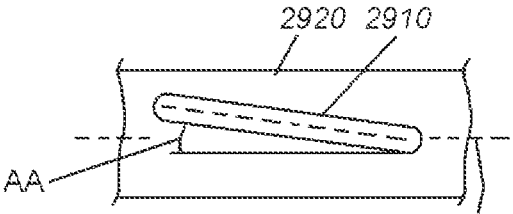
FIG. 29 is a side view of an acutely angled slot formed on a tubular plenum for inducing a permanent angle of attack in the attached multiport conduit extrusion.

A horizontal (also termed "lengthwise") slit as employed to join conduits to the outer toroidal plenum 2630 can substantially reduce the pressure rating of a given tubular extrusion without the slits by eliminating the strong hoop structure of a tubular conduit. However, a beneficial aspect of the utilization of brazed aluminum multiport extrusion is that the internally ribbed structure serves to substantially tie together and distribute the stress of internal pressure, allowing higher operation pressures, as the brazing alloy can be selected to be nearly identical in composition and strength to the composition and strength aluminum extrusions. FIG. 27 shows the use of a horizontal or "lengthwise" joint between the conduit extrusion 2710 and the plenum 2720. Braze 2730, or another joining material is provided at the joint between the components. As shown in FIG. 28, a slot 2810 is formed along the direction of the axis of elongation AE through the wall of the plenum 2720. The slot 2810 can be formed using a saw, end mill, or other similar tool. With further reference to FIG. 29, the cutting tool (mill, saw, etc.) can be applied to the plenum at a non-parallel and non-perpendicular (acute) angle AA relative to the direction of the axis of elongation AE to generate an angled slot 2920 on the surface 2910. Thus, in various embodiments the outer toroidal plenum can define an angled slot that confers a permanent angle of attack to the blade, and hence a desired axial air flow character to the device as the fan rotates about its hub.

D. Modifications to Multiport Conduit Extrusions

Figure 30:
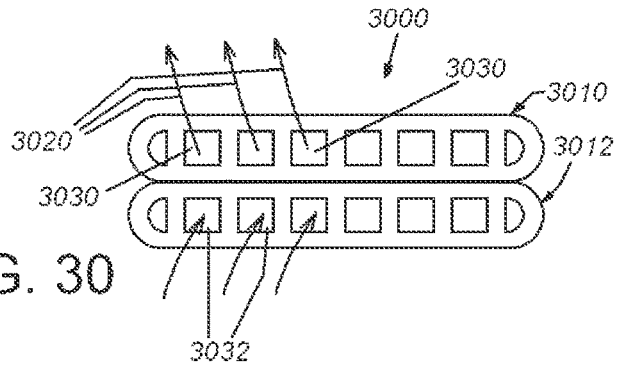
FIG. 30 is a side view of a pair of sandwiched multiport conduit extrusions arranged to enable, for example, cross fluid flow in opposing directions through each extrusion, respectively.

The use of multiport extrusion with constant cross section with aluminum brazing allows for embodiments that include internal heat exchange, which is beneficial in some refrigeration cycles. FIG. 30 shows a bladed assembly 3000 in which two multiport extrusions 3010 and 3012 then brazed together in a "sandwich" form to provide either a cocurrent or countercurrent thermal interface for heat exchange from one fluid stream to another. In operation, the fluid flow (arrows 3020) through the upper extrusion's ports 3030 occurs in a first exemplary direction, while the fluid flow (arrows 3022) through the lower extrusion ports 3032 occurs in a second, opposing, exemplary direction.

Figure 31:
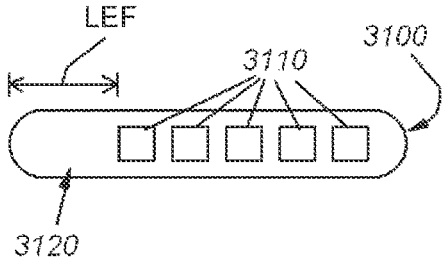
FIG. 31 is a side view of a multiport conduit extrusion having a biased arrangement of ports to generate a solid section at, for example, a leading or trailing edge.

In FIG. 31, the multiport conduit extrusion 3100 is constructed with an asymmetrical arrangement of ports 3110. As depicted, one end 3120 (e.g. a leading edge when the fan rotates) is free of ports along a length LEF. This allows for variation in heat distribution through the conduit in view the prevailing airflow direction. Additionally, by leaving the leading edge of the extrusion solid, it serves to strengthen that leading edge against abrasion or impact. Similarly, the higher solidity of the cross section confers additional tensile strength to the multiport extrusion, which is adapted to adequately support the centripetal forces of the outer toroidal plenum during operation.

Figure 32:
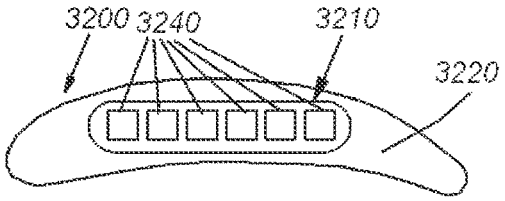
FIG. 32 is a side view of a conduit/fan blade assembly for the turbocompressor-condenser-expander device including a multiport extrusion nested within an outer aerodynamic shroud.
Figure 33:
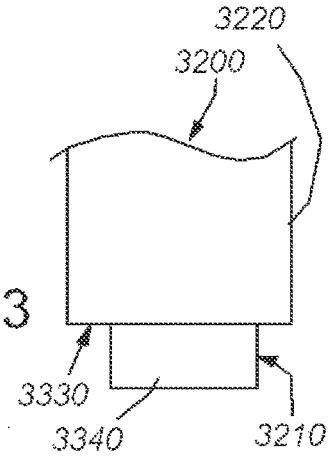
FIG. 33 is a fragmentary top view of an end of the conduit/fan blade assembly of FIG. 32.

In FIGS. 32 and 33, an overall bladed assembly 3200 is shown, in which the ports 3240 are evenly spaced within a central region of the body of an airfoil-shaped conduit structure 3200. In one embodiment, the ports 3240 are formed as part of a unitary extrusion in the shape of the depicted airfoil. In another embodiment, a separate multiport conduit extrusion 3210 defines a symmetrical cross section and (in this embodiment) evenly spaced port placement. The multiport extrusion 3210 is nested within (integral with) a separate outer aerodynamic shroud 3220 constructed from metal or another appropriate material, typically with heat-conducting properties. As shown in FIG. 33, a reduced-size (and symmetrical) end 3340 of the assembly 3200 can project outwardly along the elongated direction beyond the end 3330 of the airfoil (shroud) 3220, and is arranged to be inserted into a slot in a plenum. A similar, reduced size/symmetrical end can be provided on the opposite end of the overall bladed assembly 3200. Likewise, the shroud can terminate remote from the plenum to provide a predetermined length of exposed extrusion between the shroud end and the plenum.

In manufacture, the aerodynamic shape can be extruded with ports provided at the center as described above. The plenum-joined ends (e.g. end 3340) in such a unitary structure are machined—creating a shelf in the overall structure that engages the plenum slot. Alternatively, the extrusion 3210 can be formed separately in a manner described above, and press-fit or otherwise fixed into a conforming well or channel in the separate, outer aerodynamic shroud 3220 using, for example, clamps, fasteners, adhesives, welding, brazing, etc.). Hydraulic expansion techniques can also be used to cause the extrusion 3210 to expand and tightly engage the shroud channel of the separate shroud 3220. Alternatively, the separate shroud can be constructed in sections (e.g. clamshell halves) that are secured together after inserting the conduit extrusion into place. The shroud can define any external shape along its length—for example, the depicted airfoil shape. Note that the use of an aerodynamic outer shroud allows for wide variation in the cross section shape along the length. The cord length, camber, under-camber and general profile can vary with length to provide optimal axial airflow. The shroud can also include various valleys and protrusions to assist in guiding airflow, reducing turbulence, and generating other aerodynamic effects. Where one het-conducting component (e.g. the extrusion is mated to another components (e.g. the shroud) a heat-conducting matrix, such as thermally conductive paste, can be disposed between the components to facilitate heat transfer.

E. Multichannel Inner Plenum

Figure 34:
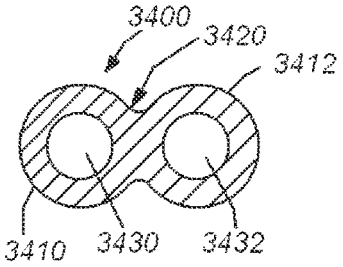
FIG. 34 is a side dross section of a multichannel tubular inner plenum for use in the bladed assembly of the turbo-compressor-condenser-expander device according to an illustrative embodiment.
Figure 35:
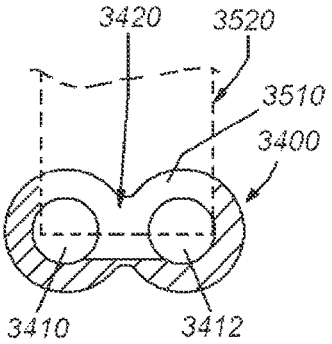
FIG. 35 is a side cross section of the multichannel plenum of FIG. 34 showing a joint with a multiport conduit extrusion according to embodiments herein.

As noted above, for the inner toroidal plenum that engages the drive hub, it can be desirable to utilize a non-circular extrusion. FIG. 34 depicts a plenum assembly 3400 defining a fusion of two tubular forms 3410 and 3412 into a single extrusion with an intermediate septum 3420 to separate the two plenum channels 3430 and 3432, respectively. As shown in FIG. 35, the multi-channel plenum 3400 is slotted vertically (slot 3510) by, for example, a milling operation. This slot forms joint to interface with a multiport conduit extrusion 3520 (shown in phantom) according to an embodiment herein. The various above-described ports (not shown in FIG. 35) of the conduit extrusion 3420 can be arranged in fluid communication with either of the two plenum channels 3410, 3412 and to avoid the septum 3420. The joint between the plenum assembly 3400 and conduit extrusion 3520 can be secured by brazing or another acceptable technique. The use of a multi-channel plenum desirably reduces the internal volume of the toroidal form, as well as allowing for increased pressure-containment potential.

Figure 36:
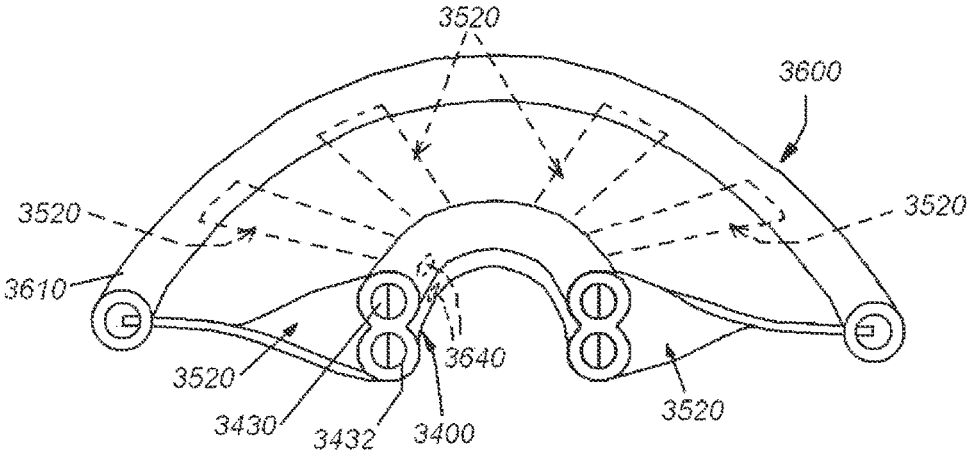
FIG. 36 is a fragmentary perspective view of a semi-circular portion of a bladed assembly of the turbocompressor-condenser-expander device including a multichannel inner plenum joined at vertical joints to a axially twisted set of conduit extrusions.

As shown in FIG. 36, the multichannel inner plenum assembly is located in an overall bladed assembly 3600. The conduit extrusions 3520 for the spokes extending between the inner plenum assembly 3400 and an outer plenum assembly 3610 in the manner of wheel spokes, with conduit extrusion ports providing fluid passage between the inner and outer plenums 3400 and 3610. Each conduit extrusion is axially twisted by 90 degrees along its length of radial extension so that the joint at the inner plenum assembly 3400 is vertical, while the joint that the outer plenum 3610 is horizontal/lengthwise. As noted the twist geometry can be customized to affect the airflow through the bladed assembly 3600 as it rotates.

Again, the inner surface of each plenum channel 3430 and 3432 can include one or more connections 3640 (shown in phantom in FIG. 36) to a fluid coupling on a drive hub.

F. Fluid Union Modifications

Figure 37:
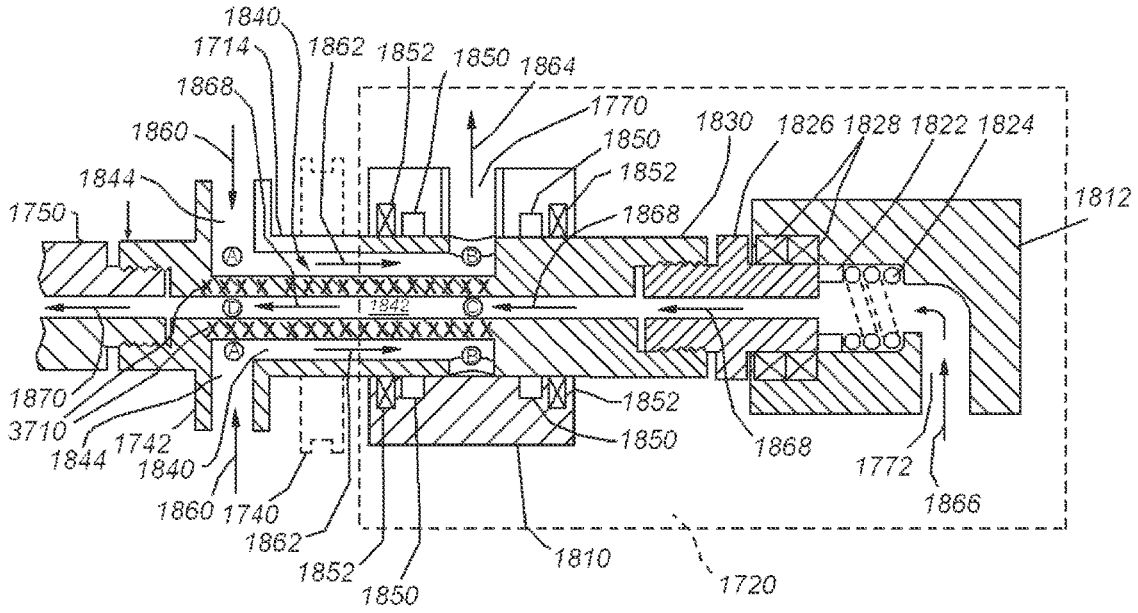
FIG. 37 is a side cross section of FIG. 18 is a side cross section of the coaxial fluid union and adjacent main shaft assembly of FIG. 18 showing modifications for use of certain types of refrigerant.

FIG. 37 is based upon FIG. 18 described generally above. Thus, like reference numbers in FIG. 37 refer to similar or identical components and functions as those described for FIG. 18. The region of counter-current refrigerant flow referenced as A, B, C and D can advantageously arranged to transfer heat in when certain types of refrigerant would benefit from such heat-transfer. However, when using alternate refrigerants, a more adiabatic arrangement, with less or no heat transfer can be desirable. In such instances, an insulating layer 3710 (shown shaded) can be provided between the inner passage 1842 and outer passages 1840.

IV. CONCLUSIONS

It should be clear that the above-described ITCCE embodiments provide a durable, efficient and cost-effective solution to the need for a more energy efficient heat-transfer system. The turbo-compressor-condenser-expander can be constructed from inexpensive components and materials, exhibit a long working life, and significantly reduce overall system component count. The various improvements provided herein to the conduit construction and plenums further enhance manufacturability of the device and its cost-effectiveness.

The foregoing has been a detailed description of illustrative embodiments of the invention. Various modifications and additions can be made without departing from the spirit and scope of this invention. Each of the various embodiments described above can be combined with other described embodiments in order to provide multiple features. Furthermore, while the foregoing describes a number of separate embodiments of the system and device of the present invention, what has been described herein is merely illustrative of the application of the principles of the present invention. For example, the isothermal turbocompressor has been illustrated having blades surrounding and encasing the spokes entirely. However, the blades can comprise any structure or orientation with respect to the spokes, wherein the blades are in thermal communication with the channels or conduits associated with each of the spokes. Further, each spoke is depicted as including or supporting one refrigerant channel/conduit, however any number of channels, conduits, pipes or tubes may be provided with respect to each spoke. Likewise, not all spokes need support one or more conduits. Some spokes can act exclusively as structural supports for the fan/wheel, and/or as fan blades. The device is highly applicable to all air conditioning, refrigeration and/or heat-pumping systems. Also, the number of conduits, tubes or passages that are disposed with respect to each spoke for the flow of refrigerant is highly variable, and the tubes or passages need not be of circular cross-section but may be varying in size and shape from tube to tube, or even along the same tube. Conduits can follow a straight path, a curved path, a sinuous path, or a path of any other shape along the blades in which they are. The arrangement of the tubes is also variable. Moreover, the shape, size and materials of the turbocompressor and any associated housings, supports, brackets, and the like are highly variable, and can be adapted to the system in which the turbocompressor is employed. In addition, the types of motor, power, control and fluid interconnections and systems associated with the turbocompressor are also highly variable and can be adapted to the particular application in which the turbocompressor/turbocompressor-condenser-expander is used. Accordingly, this description is meant to be taken only by way of example, and not to otherwise limit the scope of this invention.

What is claimed is:

1. A bladed assembly for a turbo-compressor-condenser-expander assembly comprising:

a driven central hub assembly with a first fluid coupling;

a first inner plenum in fluid communication with the fluid coupling;

a plurality of compressor conduits extending radially and passing fluid from the first inner plenum to an outer plenum, the outer plenum providing a fluid communication between radially distal regions of the compressor conduits; and a return path to a second inner plenum.

2. The bladed assembly as set forth in claim 1 wherein the compressor conduits are formed as metal extrusions.

3. The bladed assembly as set forth in claim 2 wherein the conduits include internal ribs that separate a plurality of ports formed between the ribs, thereby forming multiport conduits.

4. The bladed assembly as set forth in claim 3 wherein the ports are either (a) evenly spaced or (b) unevenly spaced to define solid areas within a cross section of the each of the conduits.

5. The bladed assembly as set forth in claim 3 wherein at least a portion of each of the compressor conduits defines a symmetrical cross section.

6. The bladed assembly as set forth in claim 5 wherein each of opposing ends of each of the compressor conduits having the symmetrical cross section is mounted in a slot on each of the first inner plenum and the outer plenum.

7. The bladed assembly as set forth in claim 6 wherein at least a portion of at least some of the compressor conduits each define an airfoil shape.

8. The bladed assembly as set forth in claim 7 wherein the airfoil shape is defined by a shroud covering an inner core having the ports.

9. The bladed assembly as set forth in claim 6 wherein at least one slot is oriented relative to a direction of elongation of the plenum (a) vertically, (b) horizontally or (c) at an acute angle.

10. The bladed assembly as set forth in claim 9 wherein at least some of the compressor conduits are axially twisted along a radial length thereof.

11. The bladed assembly as set forth in claim 1 wherein the conduits define a pair of stacked blade elements each defining a cross section having at least one port.

12. The bladed assembly as set forth in claim 1 wherein the return path includes a plurality of return conduits that extend downwardly from the outer plenum and include a bend that directs the return conduits radially inward to the second inner plenum in communication with a second fluid coupling of the driven hub assembly.

13. The bladed assembly as set forth in claim 12 wherein at least some of the return conduits define a axial twist along at least a portion thereof.

14. The bladed assembly as set forth in claim 1 wherein the inner plenum defines a multi-channel structure.

15. The bladed assembly as set forth in claim 14 wherein the multichannel structure includes a plurality of vertically oriented slots for receiving ends of the conduits, wherein a plurality of ports are in fluid communication with each channel of the multichannel structure.

16. The bladed assembly as set forth in claim 15 wherein the outer plenum defines a smaller cross sectional area than the first inner plenum so as to decrease fluid volume contained therein.

17. The bladed assembly as set forth in claim 1 wherein the conduits include a first port structure and a second port structure in thermally conductive engagement with each other, arranged so that fluid flows in a first radial direction in the first port structure and in a second, countercurrent or co-current direction in the second port structure.

18. The bladed assembly as set forth in claim 1 wherein the central hub assembly includes a precompression assembly.

19. A bladed assembly for a turbo-compressor-condenser-expander assembly comprising:

a driven central hub assembly with a first fluid coupling;

a first inner plenum in fluid communication with the fluid coupling;

a plurality of bladed compressor conduits extending radially and passing fluid from the first inner plenum to an outer plenum at the perimeter of the compressor conduits, the outer plenum bridging a fluid path between the bladed compressor conduits; and a return path to a second inner plenum.

20. The bladed assembly as set forth in claim 1 wherein the compressor conduits have multiple ports.

* * * * *